US008646884B2

(12) United States Patent
Ishibe et al.

(10) Patent No.: US 8,646,884 B2
(45) Date of Patent: Feb. 11, 2014

(54) LIQUID SUPPLY APPARATUS AND IMAGE RECORDING APPARATUS

(75) Inventors: Akinari Ishibe, Toyohashi (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 336 days.

(21) Appl. No.: 13/013,867

(22) Filed: Jan. 26, 2011

(65) Prior Publication Data

US 2011/0181671 A1 Jul. 28, 2011

(30) Foreign Application Priority Data

Jan. 26, 2010 (JP) ..... 2010-013843
Jan. 26, 2010 (JP) ..... 2010-013862

(51) Int. Cl.
*B41J 2/175* (2006.01)

(52) U.S. Cl.
USPC . 347/85; 347/7; 347/50; 347/86; 361/679.08; 720/654

(58) Field of Classification Search
None
See application file for complete search history.

(56) References Cited

U.S. PATENT DOCUMENTS

| | | | | |
|---|---|---|---|---|
| 4,635,080 | A * | 1/1987 | Watanabe | 347/50 |
| 5,448,274 | A * | 9/1995 | Hirabayashi et al. | 347/86 |
| 5,477,518 | A * | 12/1995 | Hiatt | 720/654 |
| 6,070,975 | A * | 6/2000 | Uchikata et al. | 347/86 |
| 6,422,693 | B2 * | 7/2002 | Pawlowski et al. | 347/86 |
| 7,102,881 | B2 * | 9/2006 | Park et al. | 361/679.08 |
| 2007/0222839 | A1 * | 9/2007 | Sasaki et al. | 347/86 |
| 2009/0219310 | A1 * | 9/2009 | Kondo | 347/7 |

FOREIGN PATENT DOCUMENTS

| | | |
|---|---|---|
| JP | 2005-288866 A | 10/2005 |
| JP | 2006-116784 A | 5/2006 |

* cited by examiner

*Primary Examiner* — Matthew Luu
*Assistant Examiner* — John P Zimmermann
(74) *Attorney, Agent, or Firm* — Baker Botts L.L.P.

(57) ABSTRACT

A liquid supply apparatus configured to supply a liquid, including: a liquid container to store the liquid; an installing section which is formed with an opening and to which the liquid container is installable; and an urging member which urges the liquid container installed to the installing section toward the opening, and the installing section comprises a guide section extending from the opening in an insertion direction of the liquid container from the opening, a stopper which protrudes from the guide section in a direction perpendicular to an removal direction of the liquid container from the installing section; the liquid container comprises an guide objective section guided by the guide section, and a protrusion formed on the guide objective section and which abuts against the stopper to move the liquid container in the direction perpendicular to the removal direction when the liquid container is moved in the removal direction.

16 Claims, 21 Drawing Sheets

LIQUID SUPPLY APPARATUS AND IMAGE RECORDING APPARATUS

CROSS REFERENCE TO RELATED APPLICATION

The present application claims priority from Japanese Patent Applications No. 2010-013843, filed on Jan. 26, 2010 and No. 2010-013862, filed on Jan. 26, 2010, the disclosures of which are incorporated herein by reference in their entirety.

BACKGROUND OF THE INVENTION

1. Field of the Invention

The present invention relates to a liquid supply apparatus in which a liquid container is installable to an installing section via an opening and an urging member urges the liquid container toward the opening when the liquid container is installed in the installing section, and an image recording apparatus in which the liquid supply apparatus is provided.

2. Description of the Related Art

An image recording apparatus has been hitherto known, in which an image is recorded on a recording sheet of paper by using an ink or inks. The image recording apparatus is provided with a ink jet recording head, and ink droplets are selectively jetted from nozzles of the recording head toward the recording sheet of paper. The ink droplets are landed on the recording sheet of paper, and thus the desired image is recorded on the recording sheet of paper. A liquid container, which stores ink to be supplied to the recording head, is provided for the image recording apparatus. One example of the liquid container is a liquid cartridge, which is configured to be inserted into and removed from a installing section provided in the image recording apparatus. A liquid cartridge storing ink is also referred to as an "ink cartridge".

When the ink cartridge runs out of ink, the ink cartridge is removed from the installing section of the image recording apparatus, and then a new ink cartridge, which stores ink, is installed into the installing section. The installing section has a lock structure configured to lock, hold, or retain the ink cartridge in a specific position in the installing section. The installing section also has an urging member configured to urge the ink cartridge in a direction in which the ink cartridge is removed from the installing section when the ink cartridge is locked, held, or retained by the lock structure. When the ink cartridge is intended to be removed from the installing section, the ink cartridge is released from the locked state, and the ink cartridge is moved toward the outside of the installing section with a force applied by the urging member. Accordingly, a user can readily remove the ink cartridge from the installing section.

If the ink cartridge is moved with a great force, the ink cartridge may jump out of the installing section. If the ink cartridge jumps out of the installing section, the ink cartridge may fall down and contact a surface, and the impact of contacting the surface may cause the ink stored in the ink cartridge to splash out. Further, the ink cartridge may be broken when the ink cartridge contacts the surface.

A known installing section, such as a installing section described in Japanese Patent Application Laid-open No. 2005-288866, has a structure for preventing the ink cartridge from jumping out of the mounting portion. More specifically, the installing section is provided with an elastically deformable hook pawl. The hook pawl is configured to engage an edge of a engaging recess formed in an ink cartridge at a predetermined timing when the ink cartridge moves toward the outside of the mounting portion. With this engagement, the ink cartridge is prevented from jumping out of the installing section.

However, when replacement of the ink cartridge is repeatedly and the hook pawl is repeatedly elastically deformed many times, the hook pawl may be fatigued and may become unable to elastically return to its original position or the deformation amount thereof may be reduced due to the fatigue, or the hook pawl may even be fractured off In such cases, the function of the hook pawl, i.e., the prevention of the ink cartridge from jumping out of the installing section, is no longer effective. In order to restore the function, it is necessary to replace the installing section having the hook pawl.

SUMMARY OF THE INVENTION

Therefore, a need has arisen for a liquid supply apparatus and an image recording apparatus, which overcome these and other shortcomings of the related art. A technical advantage of the present invention is that the likelihood that a liquid container jumps out of an installing section is reduced, with a structure of the liquid container and the installing section, which are suitable for repeated use.

According to an aspect of the present invention, there is provided a liquid supply apparatus comprising: a liquid container configured to store the liquid therein; an installing section which is formed with an opening, wherein the liquid container is configured to be inserted into the installing section via the opening in an insertion direction and thereby installed in the installing section; and an urging member configured to urge the liquid container installed in the installing section toward the opening. The installing section comprises: a guide section which extends from the opening in the insertion direction; at least one stopper which protrudes from the guide section or from a portion adjacent to the guide section in a direction perpendicular to a removal direction which is opposite to the insertion direction; and a holding member configured to releasably hold the liquid container in the installing section against an urging force exerted by the urging member. The liquid container comprises a storage chamber configured to store the liquid therein; a guide objective section configured to move in the insertion direction and the removal direction, guided by the guide section, when the liquid container is inserted into and removed from the installing section; and at least one protrusion provided on or adjacent to the guide objective section and configured to abut against the at least one stopper, such that the liquid container moves in the direction perpendicular to the removal direction, when the liquid container is moved in the removal direction. The at least one stopper comprises a plurality of stoppers which are offset in the removal direction and/or the at least one protrusion comprises a plurality of protrusions which are offset in the removal direction.

The liquid container is inserted into the installing section via the opening and thereby installed in the installing section. When the liquid container is installed in the installing section, the liquid container is urged by the urging member. However, the holding member holds the liquid container in the installing section against the urging force of the urging member.

When the liquid container is released from the state held by the holding member, the liquid container is moved toward the opening by the urging force of the urging member. When the liquid container is moved toward the opening, the guide objective section is moved along the guide section, and the at least one protrusion of the guide objective section abuts against the at least one stopper of the guide section. By this abutment, the liquid container is moved in the direction perpendicular to the removal direction while the guide objective section is guided by the guide section. In accordance with the movement of the liquid container in the direction perpendicular to the removal direction, the velocity of movement of the liquid container toward the opening is attenuated or damped. As for the at least one stopper and the at least one protrusion, a plurality of stoppers and/or a plurality of protrusions are provided being offset in the removal direction. Therefore, the stopper abuts against the protrusion a plurality of times and/or the protrusion abuts against the stopper a plurality of times. Accordingly, the liquid container is moved in the direction perpendicular to the removal direction a plurality of times, and the velocity of movement of the liquid container toward the opening is further attenuated or damped, and the liquid container stops moving. In this way, the likelihood that the liquid container jumps out of the installing section is reduced, with the structure of the liquid container and the installing section, which are suitable for repeated use.

The position where the liquid container stops is not limited to the position at which the protrusion abuts against the stopper. For example, the velocity of the liquid container may be attenuated or damped each time the protrusion abuts against the stopper, and the liquid container may stop after the protrusion passes over all of the plurality of stoppers.

In the present invention, the protrusion may extend from a surface in a direction intersecting the surface, may be formed in a stepped form, or may be formed in a dome form extending continuously from the surface with a smooth curved profile Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DESCRIPTION OF THE PREFERRED EMBODIMENTS

Embodiments of the present invention, and their features and advantages, may be understood by referring to FIGS. 1-21, like numerals being used for like corresponding parts in the various drawings.

First Embodiment

Outline of Printer 10

Figure 1:
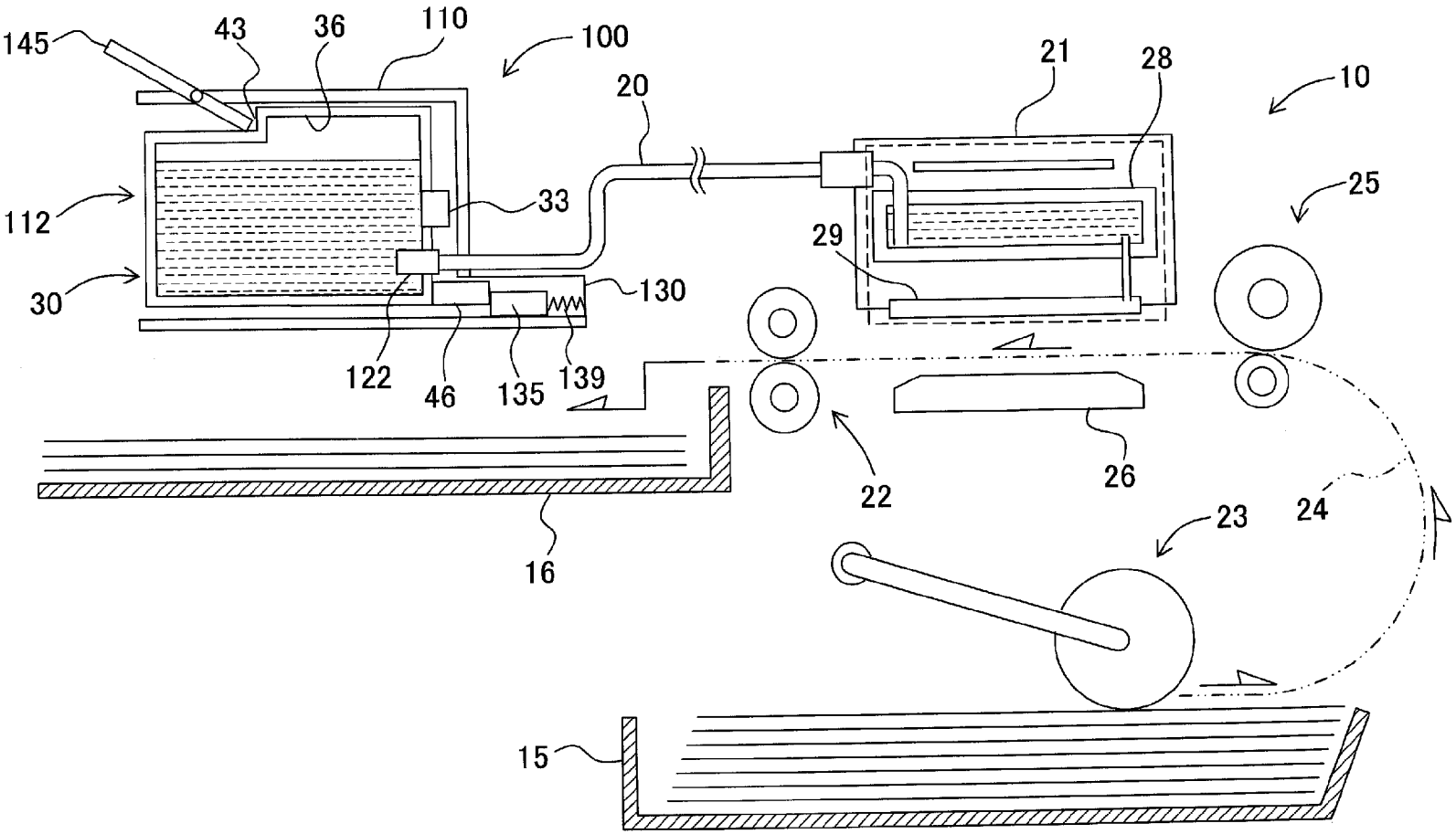
FIG. 1 is a schematic cross-sectional view of a printer provided with an ink supply apparatus according to first and second embodiments of the present invention.

Referring to FIG. 1, a printer 10 according to a first embodiment of the present invention, is an ink-jet printer configured to record an image by selectively discharging ink droplets onto a recording sheet of paper The printer 10 comprises an ink supply apparatus 100. The ink supply apparatus 100 comprises a cartridge installing section 110. An ink cartridge 30 is configured to be installed in the cartridge installing section 110. The cartridge installing section 110 is provided with an opening 112 through which the inside of the cartridge installing section 110 is open to the outside. The ink cartridge 30 is inserted into the cartridge installing section 110 via the opening 112, and thereby the ink cartridge 30 is installed in the cartridge installing section 110. On the other hand, the ink cartridge 30 is removed from the cartridge installing section 110 via the opening 112. The printer 10 is an example of an image recording apparatus, and the ink supply apparatus 100 is an example of a liquid supply apparatus.

Ink, which is usable for the printer 10, is stored in the ink cartridge 30. The ink cartridge 30 is fluidly connected to a recording head 21 via an ink tube 20 when the ink cartridge 30 is installed in the cartridge installing section 110. The recording head 21 comprises a sub-tank 28. The sub-tank 28 is configured to temporarily store the ink supplied via the ink tube 20. The ink, which is supplied from the sub-tank 28, is selectively discharged from nozzles 29 by the recording head 21. The recording head 21 is an example of a recording section.

The recording sheet of paper, which is fed from a paper feed tray 15 to a transport passage 24 by a paper feed roller 23, is transported onto a platen 26 by means of a pair of transport rollers 25. The recording head 21 is configured to selectively discharge the ink toward the recording sheet of paper passing over the platen 26. Accordingly, the image is recorded on the recording sheet of paper. The recording sheet of paper, which has passed over the platen 26, is discharged by a pair of discharge rollers 22 to a paper discharge tray 16 provided on the most downstream side of the transport passage 24.

Ink Cartridge 30

Figure 2:
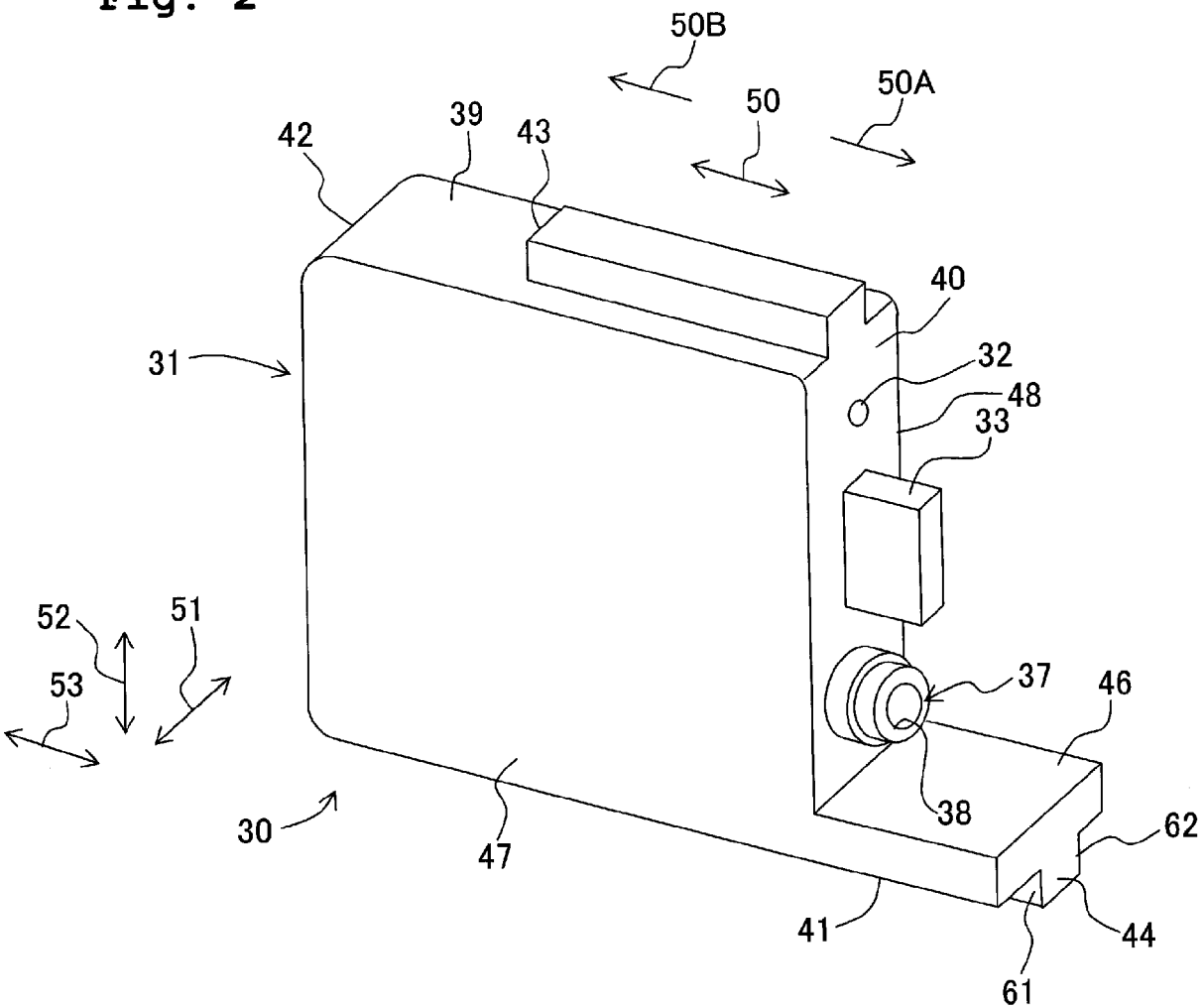
FIG. 2 shows a perspective of an ink cartridge of the first embodiment.
Figure 3:
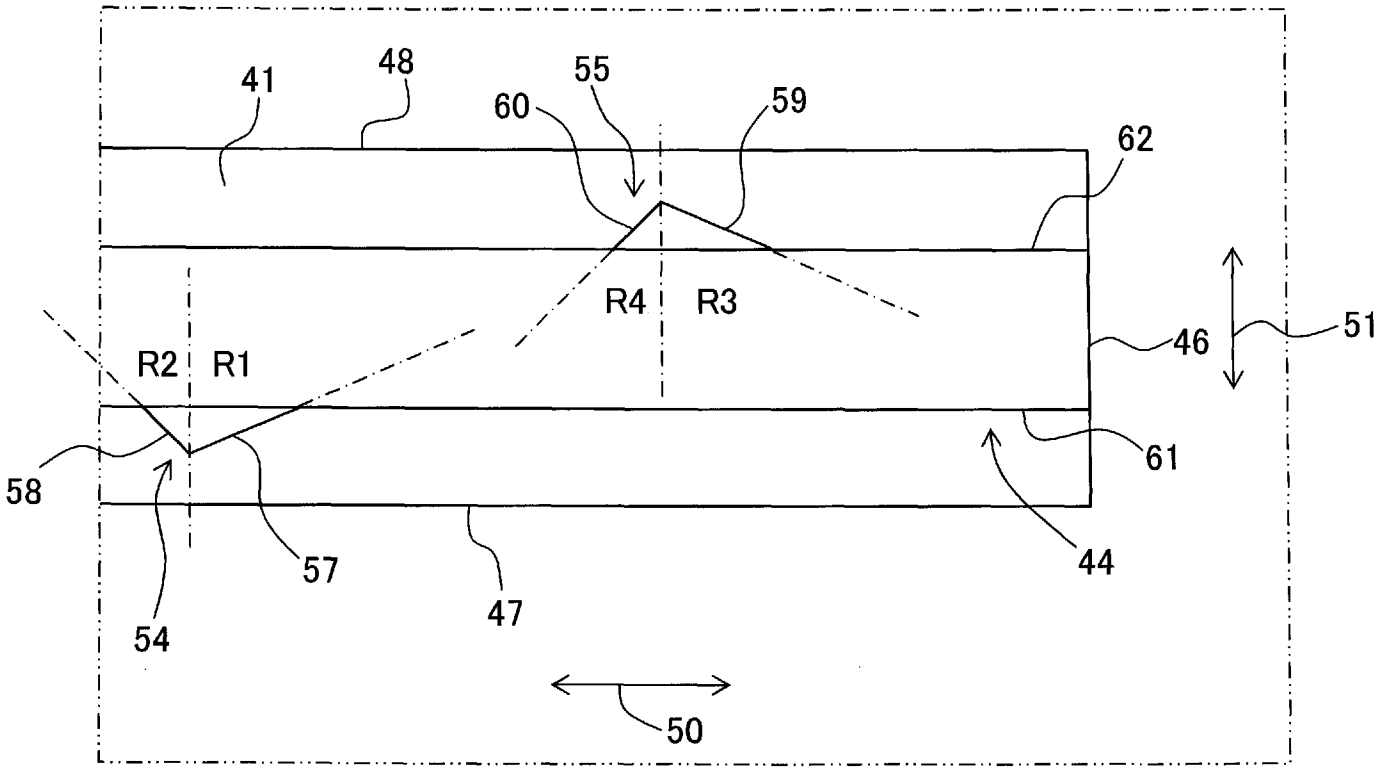
FIG. 3 shows an enlarged bottom view of the ink cartridge of the first embodiment in the vicinity of protrusions.
Figure 4:
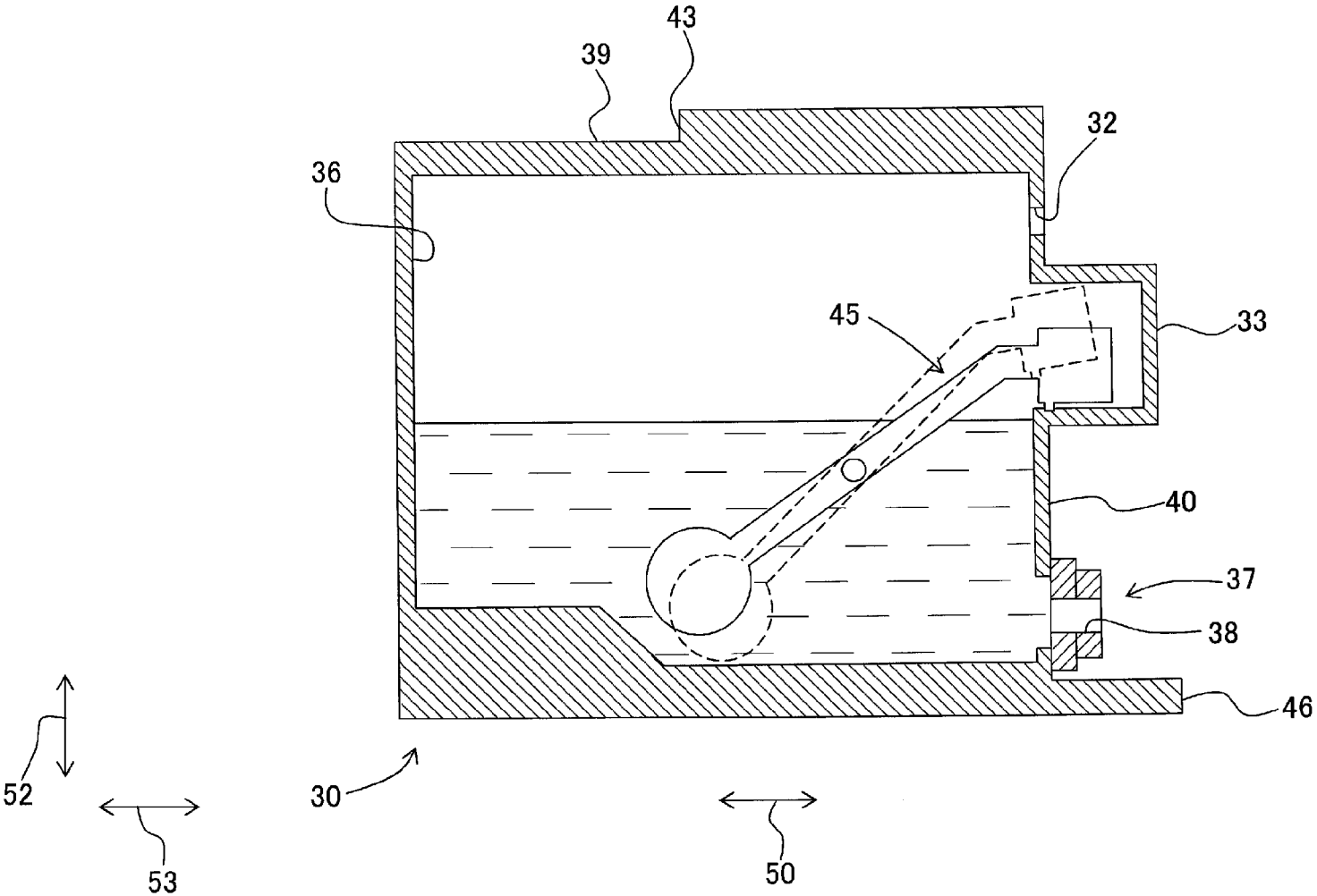
FIG. 4 is a cross-sectional view of the ink cartridge of the first embodiment.

As shown in FIGS. 2 to 4, the ink cartridge 30 is a container configured to store ink therein. The ink cartridge 30 comprises a main body 31 forming an outer appearance of the ink cartridge 30. An ink chamber 36 is formed as a space which is formed in the ink cartridge 30. The ink chamber 36 may be a space directly formed in the main body 31. Alternatively, the ink chamber 36 may be a space which is formed in a container which is disposed in the main body 31. The ink cartridge 30 is an example of a liquid container. The ink chamber 36 is an example of a storage chamber.

The ink cartridge 30 is configured to be inserted into the cartridge installing section 110 in an insertion direction indicated by an arrow 50A and removed from the cartridge installing section 110 in the removal direction indicated by an arrow 50B in an upstanding state shown in FIG. 2, i.e., with the top surface of the ink cartridge 30, as shown in FIG. 2, may face upward and the bottom surface of the ink cartridge 30, as shown in FIG. 2, may face downward. The ink cartridge 30 is inserted into and removed from the cartridge installing section 110 while maintaining the upstanding state. In the following description, the insertion direction 50A and the removal direction 50B are conveniently referred to in combination as "insertion/removal direction 50".

The main body 31 of the ink cartridge 30 has substantially a parallelepiped shape. The main body 31 has a width in a width direction 51, a height in a height direction 52, and a depth in a depth direction 53. The width direction 51, the height direction 52, and the depth direction 53 are perpendicular to each other. The main body 31 has a flat shape in which the width of the main body 31 is less than the height and the depth of the main body 31. The main body 31 comprises a front wall 40, which is disposed on the front side of the main body 31 when the ink cartridge 30 is inserted into the cartridge installing section 110, and comprises a back wall 42, which is disposed on the back side of the main body 31 when the ink cartridge 30 is inserted into the cartridge installing section 110. The front wall 40 and the back wall 42 are aligned in the depth direction 53. When the ink cartridge 30 is inserted into the installing section 110, the depth direction 53 is parallel to the insertion/removal direction 50, and the width direction 51 and the height direction 52 are perpendicular to the insertion/removal direction 50. Therefore, when the ink cartridge 30 is inserted into the installing section 110, the front wall 40 and the rear wall 42 are aligned in the insertion/removal direction 50. In this embodiment, the insertion/removal direction 50 is a horizontal direction, and therefore, when the ink cartridge 30 is inserted into or removed from the installing section 110, each of the width direction 51 and the depth direction 53 is a horizontal direction and the height direction 52 is the vertical direction (direction of gravity).

The main body 31 comprises a remaining amount detection section 33 disposed at the front wall 40 at substantially the center of the front wall 40 in the height direction 52. The remaining amount detection section 33 has a box shape having an opening, through which the inside of the remaining amount detection section 33 is in fluid communication with the ink chamber 36. Further, the remaining amount detection section 33 comprises a pair of walls composed of a light-transmissive resin to allow infrared light emitted from an optical sensor 114 (see FIG. 5) to pass therethrough. When the ink cartridge 30 is installed in the cartridge installing section 110, depending on the amount of ink in the ink chamber 36, the remaining amount detection section 33 is configured to either allow the infrared light emitted from the optical sensor 114 to pass therethrough, or block or attenuate the infrared light. Whether the remaining amount detection section 33 allows the infrared light to pass therethrough or block or attenuate the infrared light is detected and a controller of the printer 10 determines whether the amount of ink stored in the ink chamber 36 is less than a predetermined amount based on the detection. For example, the remaining amount detection section 33 comprises an opaque detection element 45 positioned in the inside of the remaining amount detection section 33. The detection element 45 moves according to the amount of ink stored in the ink chamber 36, and the remaining amount detection section 33 is configured to either allow the infrared light emitted from the optical sensor 114 to pass therethrough, or to block or attenuate the infrared light, depending on the movement of the detection element 45. More specifically, the detection element 45 is configured to move between a position where the detection element 45 intersects the optical path of the infrared light and a position where the detection element 45 does not intersect the optical path of the infrared light. A wall of the remaining amount detection section 33 which is irradiated with the infrared light of the optical sensor 114 may extend in the vertical direction, i.e., the height direction 52, or in a direction intersecting the vertical direction, i.e., the height direction 52.

The main body 31 comprise an atmospheric air communication port 32 formed through the front wall 40 and the atmospheric air communication port 32 is positioned above the remaining amount detection section 33. The atmospheric air communication port 32 penetrates through the front wall 40 in the depth direction 53. As described above, the ink chamber 36 is configured to store ink therein, and an air layer is formed above the ink surface of the ink stored in the ink chamber 36. The air in the air layer of the ink chamber 36 and the atmospheric air outside the main body 31 may be brought into communication with each other via the atmospheric air communication port 32. Although not shown in the respective drawings, the atmospheric air communication port 32 is configured to be selectively opened and closed by a valve. When the atmospheric air communication port 32 is opened, the air pressure in the ink chamber 36 becomes equal to the atmospheric pressure outside the main body 31. The atmospheric air communication port 32 is not required to be positioned at the front wall 40. In another embodiment, the atmospheric air communication port 32 may be placed at other positions, while maintaining the configuration to allow the interior and the exterior of the ink chamber 36 to be brought into communication with each other via the atmospheric air communication port 32. Moreover, in yet another embodiment, when the ink cartridge 30 is used in a state in which the interior of the ink chamber 36 is maintained at a negative pressure, the atmospheric air communication port 32 may be omitted.

The main body 31 comprises an ink supply section 37 positioned at the front wall 40 below the remaining amount detection section 33. The ink supply section 37 has a cylindrical outer shape. The ink supply section 37 protrudes outward from the front wall 40 in the insertion direction 50A. The ink supply section 37 has an ink flow passage 38 formed therein, and the ink flow passage 38 extends in the insertion/removal direction 50. The ink supply section 37 is configured such that ink may flow out from the ink chamber 36 via the ink flow passage 38 to an ink tube 122 (See FIGS. 1 and 5) provided in the cartridge installing section 110.

The main body 31 comprises an upper wall 39 extending from the upper end of the front wall 40 to the upper end of the back wall 42. The main body 31 also comprises an engaging section 43 at substantially the center of the upper wall 39 in the depth direction 53. The engaging section 43 comprises a projection having a planar surface which extends in the width direction 51 and the height direction 52 of the ink cartridge 30. A lock lever 145 (See FIG. 5) is configured to engage with the engaging section 43 when the ink cartridge 30 is installed in the cartridge installing section 110 as described later on.

The main body 31 also comprises a projection 46. The projection 46 extends from the lower end of the front wall 40 of the main body 31 in the insertion direction 50A and away from the back wall 42. The projection 46 is positioned below the ink supply section 37. The width of the projection 46 is substantially equal to the width of the front wall 40 in the width direction 51. The distal end of the projection 46 extends up to a position further from the ink chamber 36 than the distal end of the ink supply section 37 does.

The main body 31 comprises a lower wall 41 opposite the upper wall 39 in the height direction 52, and the ink cartridge 30 comprises an guide objective section 44 extending downward from the lower wall 41. The guide objective section 44 extends in the depth direction 53. The guide objective section 44 comprises a surface 61 and a surface 62 opposite the surface 61 in the width direction 51. Each of the surfaces 61, 62 extends in the height direction 52 and the depth direction 53. The surfaces 61, 62 are positioned more inside than a right side surface 47 and a left side surface 48 of the main body 31 in the width direction 51. In other words, the guide objective section 44 has a width narrower than that of the main body 31 in the width direction 51. When the ink cartridge 30 is inserted into and removed from the installing section 110, the guide objective section 44 is inserted into and move in a groove 115, which will be described later. The surfaces 61, 62 of the guide objective section 44 faces side surfaces 117, 118, which partially define the groove 115.

As shown in FIG. 3, the ink cartridge 30 comprises a protrusion 54, which protrudes outwardly in the width direction 51 from the surface 61 of the guide objective section 44, and a protrusion 55, which protrudes outwardly in the width direction 51 from the surface 62 of the guide objective section 44. The directions in which the protrusions 54, 55 protrudes from the surfaces 61, 62 are opposite to one another in the width direction 51. The protrusions 54, 55 are disposed being offset in the insertion/removal direction 50. In other words, the protrusions 54, 55 are separated from each other in the insertion/removal direction 50. The protrusions 54, 55 protrude toward the side surfaces 117, 118 of the groove 115, respectively, when the ink cartridge 30 is installed in the cartridge installing section 110. The protrusions 54, 55 abut against stoppers 124, 125, which will be described later, respectively, when the ink cartridge 30 is inserted into and removed from the cartridge installing section 110.

The protrusion 54 comprises a first inclined surface 57 which is positioned on the front wall 40 side of the protrusion 54 and which is inclined with respect to the width direction 51 and a second inclined surface 58 which is positioned on the back wall 42 side of the protrusion 54 and which is inclined with respect to the width direction 51. The first inclined surface 57 and the second inclined surface 58 are formed continuously in the insertion/removal direction 50. The protrusion 54 has a triangular shape as viewed in a bottom view. Therefore, the first inclined surface 57 abuts against the stopper 124 as described later such that the ink cartridge 30 moves in the width direction 51 when the ink cartridge 30 is inserted into the cartridge installing section 110. The second inclined surface 58 abuts against the stopper 124 as described later such that the ink cartridge 30 moves in the width direction 51 when the ink cartridge 30 is removed from the cartridge installing section 110.

Each of the first inclined surface 57 and the second inclined surface 58 is a planar surface which is inclined with respect to the horizontal direction which is perpendicular to the insertion/removal direction 50, in other words, inclined with respect to the width direction 51. However, the first inclined surface 57 and the second inclined surface 58 differ in the angle of inclination with respect to the horizontal direction (the width direction 51) which is perpendicular to the insertion/removal direction 50. A first angle R1 which is formed as an acute angle between the first inclined surface 57 and the horizontal direction (the width direction 51) which is perpendicular to the insertion/removal direction 50 is greater than a second angle R2 which is formed as an acute angle between the second inclined surface 58 and the horizontal direction (the width direction 51) which is perpendicular to the insertion/removal direction 50. In other words, the first inclined surface 57 is a gentle inclined surface, and the second inclined surface 58 is a steep inclined surface.

The protrusion 55 comprises a third inclined surface 59 which is positioned on the front wall 40 side of the protrusion 55 and which is inclined with respect to the width direction 51 and a fourth inclined surface 60 which is positioned on the back wall 42 side of the protrusion 55 and which is inclined with respect to the width direction 51. The third inclined surface 59 and the fourth inclined surface 60 are formed continuously in the insertion/removal direction 50. The protrusion 55 has a triangular shape as viewed in a bottom view. Therefore, the third inclined surface 59 abuts against the stopper 125 as described later such that the ink cartridge 30 moves in the width direction 51 when the ink cartridge 30 is inserted into the cartridge installing section 110. The fourth inclined surface 60 abuts against the stopper 125 as described later such that the ink cartridge 30 moves in the width direction 51 when the ink cartridge 30 is removed from the cartridge installing section 110.

Each of the third inclined surface 59 and the fourth inclined surface 60 is a planar surface which is inclined with respect to the horizontal direction which is perpendicular to the insertion/removal direction 50, in other words, inclined with respect to the width direction 51. However, the third inclined surface 59 and the fourth inclined surface 60 differ in the angle of inclination with respect to the horizontal direction (the width direction 51) which is perpendicular to the insertion/removal direction 50. A third angle R3 which is formed as an acute angle between the third inclined surface 59 and the horizontal direction (the width direction 51) which is perpendicular to the insertion/removal direction 50 is greater than a fourth angle R4 which is formed as an acute angle between the fourth inclined surface 60 and the horizontal direction (the width direction 51) which is perpendicular to the insertion/removal direction 50. In other words, the third inclined surface 59 is a gentle inclined surface, and the fourth inclined surface 60 is a steep inclined surface.

The respective protrusions 54, 55 have distal ends each of which is positioned inwardly from the right side surface 47 or the left side surface 48 of the main body 31 in the width direction 51. The distance between the distal ends of the respective protrusions 54, 55 in the width direction 51 is less than the distance between the side surfaces 117, 118 of the groove 115. Therefore, the respective distal ends 54, 55 can enter the groove 115 to move smoothly in the groove 115in the insertion/removal direction 50 provided that the respective distal ends 54, 55 do not abut against the stoppers 124, 125 as described later.

Cartridge Installing Section 110

Figure 5:
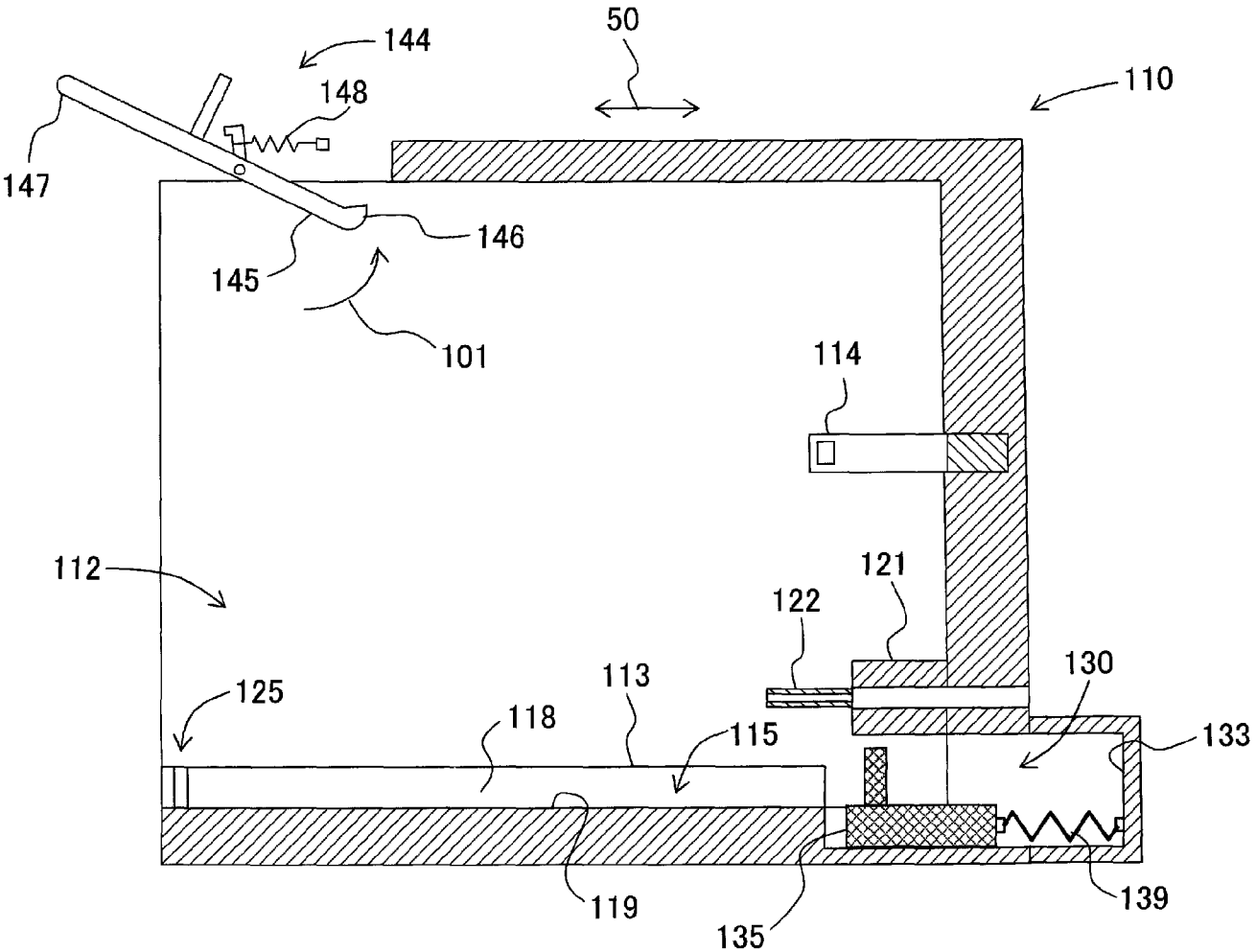
FIG. 5 is a cross-sectional view of a cartridge installing section of the first embodiment.

As shown in FIGS. 1 and 5, the cartridge installing section 110 has the opening 112 which is disposed on the front side of the printer 10. As described above, the ink cartridge 30 is configured to be inserted into the cartridge installing section 110 in the insertion direction 50A via the opening 112 and thereby installed in the installing section 110. The ink cartridge 30 also is configured to be removed from the cartridge installing section 110 in the removal direction 50B via the opening 112. The cartridge installing section 110 has the groove 115 formed in a bottom surface 113 which defines the bottom of the inner space of the cartridge installing section 110. The groove 115 extends from the opening 112 in the insertion direction 50A. When the ink cartridge 30 is inserted into and removed from the installing section 110, the ink cartridge 30 is guided in the insertion/removal directions 50 by the guide objective portion 44 positioned in the groove 115.

The cartridge installing section 110 comprises, the optical sensor 114, a lock mechanism 144, a slide member 135, a coil spring 139, a connecting section 121, and the stoppers 124, 125.

As shown in FIG. 5, the optical sensor 114 is provided at an end portion of the cartridge installing section 110 opposite the opening 112 in the insertion/removal direction 50 in the inner space of the cartridge installing section 110. The optical sensor 114 is a photo-interrupter comprising a light emission element such as a light emitting diode configured to emit infrared light and a light-receiving element such as a phototransistor which is configured to receive the infrared light emitted from the light-emitting element. The light-emitting element and the light-receiving element are aligned in a direction perpendicular to the plane formed by the paper on which FIG. 5 is illustrated.

When the ink cartridge 30 is positioned in the cartridge installing section 110, the remaining amount detection section 33 may be positioned between the light emission element and the light-receiving element of the optical sensor 114. When the ink cartridge 30 is positioned in the cartridge installing section 110, the controller of printer 10 may determine whether the remaining amount of ink stored in the ink chamber 36 is less than the predetermined amount, depending on whether the light-receiving element of the optical sensor 114 receives the infrared light passing the through the remaining amount detection portion 33.

The slide member 135 is disposed in a space 130 which is formed in the lower end of the end portion of the cartridge installing section 110. The space 130 is contiguous with the inner space of the cartridge installing section 110. The slide member 135 is configured to slide in the insertion/removal direction 50 in the space 130. The slide member 135 is disposed in the line of the travel of the projection 46 of the ink cartridge 30 when the ink cartridge 30 is inserted in to the cartridge installing section 110. The slide member 135 is configured to abut against the projection 46.

The coil spring 139 is disposed in the space 130. The coil spring 139 is configured to elastically urge the slide member 135 toward the opening 112, i.e., in the removal direction 50B. The coil spring 139 extends in the insertion/removal direction 50 in the space 130. The coil spring 139 has one end which is connected to a back wall 133 which defines an end of the space 130 opposite the inner space of the cartridge installing section 110 in the insertion/removal direction 50. The other end of the coil spring 139 is connected to the slide member 135. When the coil spring 139 is at its natural length, i.e., when an external force is not applied to the slide member 135, the slide member 135 is positioned at an end of the space 130 closer to the opening 112. The projection 46 of the ink cartridge 30 abuts against the slide member 135 when the ink cartridge 30 is inserted into the cartridge installing section 110, and the slide member 135 is pressed by the ink cartridge 30 toward the back wall 133 of the space 130. Accordingly, the coil spring 139 is contracted, and the slide member 135 slides to the back wall 133 side of the space 130 (see FIG. 6). The slide member 135 and the coil spring 139 are an example of an urging member.

The lock mechanism 144 is configured to releasably hold or retain the ink cartridge 30 in the cartridge installing section 110 against an urging force of the sliding member 135 and the spring 139, and to prevent the ink cartridge 30 from moving in the removal direction 50B when the lock mechanism 144 is engaged with the ink cartridge 30.

The lock mechanism 144 comprises the lock lever 145 and a coil spring 148 configured to apply an urging force to the lock lever 145. The lock lever 145 is configured to pivot from a lock position, shown in FIG. 5, toward an unlock position in a direction indicated by an arrow 101. The lock lever 145 is constantly urged toward the lock position by the coil spring 148 when an external force is not applied to the lock lever 145. The lock lever 145 comprises an engaging end 146 disposed at one end of the lock lever 145 and an operating section 147 disposed at the other end of the lock lever 145. The ink cartridge 30 is locked, held, or retained in the cartridge installing section 110 when the engaging end 146 of the lock mechanism 144 is engaged with the engaging section 43 of the ink cartridge 30. When a user presses the operating section 147 downwardly, the lock lever 145 moves from the lock position to the unlock position. The lock lever 145 is an example of a holding member.

The connecting section 121 is disposed at the end portion of the cartridge installing section 110. The connecting section 121 comprises the tubular ink tube 122. The ink tube 122 is a tubular member extending in the insertion/removal direction 50. The ink tube 122 is connected to the ink tube 20 outside the cartridge installing section 110. When the ink cartridge 30 is installed in the cartridge installing section 110, the ink tube 122 is inserted into the ink supply section 37, and the ink supply section 37 and the connecting section 121 are connected to one another. Accordingly, ink is supplied from the ink chamber 36 via the ink tube 122 to the ink tube 20. The ink tube 20 is omitted in FIGS. 5 and 6.

The groove 115, which extends from the opening 112 to the end portion of the cartridge installing section 110 in the insertion direction 50A, is formed in the bottom surface 113 which defines the bottom portion of the inner space of the cartridge installing section 110. The groove 115 is defined by the pair of side surfaces 117, 118 and a bottom surface 119 which connects the side surfaces 117, 118. The groove 115 extends to the bottom surface 119 downwardly in the vertical direction from the bottom surface 113. The side surfaces 117, 118 are opposed to one another and extend in the insertion/removal direction 50. The side surface 117 does not appear in FIGS. 5 and 6.

The pair of stoppers 124, 125 is provided on the side surfaces 117, 118 of the groove 115, respectively, adjacent to the opening 112. The stopper 124 protrudes from the side surface 117 toward the side surface 118, and the stopper 125 protrudes from the side surface 118 toward the side surface 117.

Figure 7:
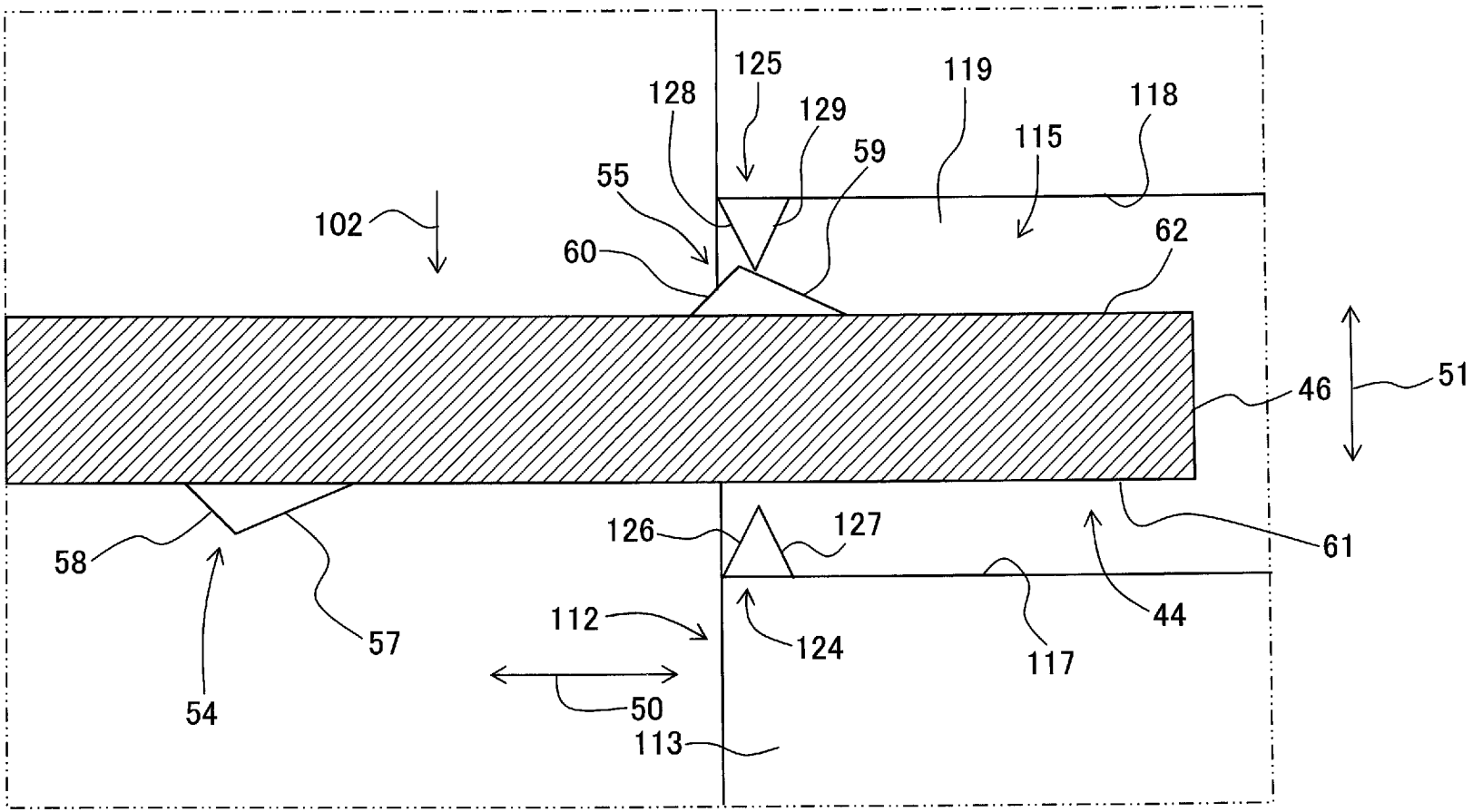
FIG. 7 is an enlarged view of the ink cartridge and the cartridge installing section of the first embodiment in the vicinity of the protrusions of the ink cartridge and stoppers of the cartridge installing section when the ink cartridge is inserted into the cartridge installing section, corresponding to a cross-sectional view taken along line VII-VII in FIG. 6.

As shown in FIG. 7, the stoppers 124, 125 have the same shape except that they are differently arranged. The stopper 124 comprises a first inclined surface 126 which is positioned on the opening 112 side of the stopper 124 and which is inclined with respect to the horizontal direction (the width direction 51) which is perpendicular to the insertion/removal direction 50 and a second inclined surface 127 which is positioned on the end portion (of the cartridge installing section 110 provided with the optical sensor 114 and the connecting section 121) side of the stopper 124 and which is inclined with respect to the horizontal direction (the width direction 51) which is perpendicular to the insertion/removal direction 50. The first inclined surface 126 and the second inclined surface 127 are formed continuously in the insertion/removal direction 50. The stopper 124 has a triangular shape as viewed in a plan view. Therefore, the first inclined surface 126 abuts against the protrusion 54 such that the ink cartridge 30 moves in the horizontal direction (the width direction 51) which is perpendicular to the insertion/removal direction 50 when the ink cartridge 30 is inserted into the cartridge installing section 110. The second inclined surface 127 abuts against the protrusion 54 such that the ink cartridge 30 moves in the horizontal direction (the width direction 51) which is perpendicular to the insertion/removal direction 50 when the ink cartridge 30 is removed from the cartridge installing section 110.

The stopper 125 comprises a third inclined surface 128 which is positioned on the opening 112 side of the stopper 125 and which is inclined with respect to the horizontal direction (the width direction 51) which is perpendicular to the insertion/removal direction 50 and a fourth inclined surface 129 which is positioned on the end portion (of the cartridge installing section 110) side of the stopper 125 and which is inclined with respect to the horizontal direction (the width direction 51) which is perpendicular to the insertion/removal direction 50. The third inclined surface 128 and the fourth inclined surface 129 are formed continuously in the insertion/removal direction 50. The stopper 125 has a triangular shape as viewed in a plan view. Therefore, the third inclined surface 128 abuts against the protrusion 55 such that the ink cartridge 30 moves in the horizontal direction (the width direction 51) which is perpendicular to the insertion/removal direction 50 when the ink cartridge 30 is inserted into the cartridge installing section 110. The fourth inclined surface 129 abuts against the protrusion 55 such that the ink cartridge moves 30 in the horizontal direction (the width direction 51) which is perpendicular to the insertion/removal direction 50 when the ink cartridge 30 is removed from the cartridge installing section 110.

Inserting/Removing Operation of Ink Cartridge 30

When the ink cartridge 30 is inserted into the cartridge installing section 110 via the opening 112 with the front wall 40 facing forward in the insertion direction 50A, the guide objective section 44 of the ink cartridge 30 is inserted into the groove 115 of the cartridge installing section 110. The ink cartridge 30 is guided in the insertion/removal direction 50 by the contact between the guide objective section 44 and the groove 115.

During the insertion of the ink cartridge 30 into the cartridge installing section 110 in the insertion direction 50A, the pair of protrusions 54, 55 of the ink cartridge 30 abut against the stoppers 124, 125, respectively. The distance between the distal ends of the stoppers 124, 125 in the horizontal direction (the width direction 51) which is perpendicular to the insertion/removal direction 50 is less than the distance between the distal end of the protrusion 54 and the distal end of the protrusion 55 in the horizontal direction (the width direction 51) which is perpendicular to the insertion/removal direction 50. Therefore, the protrusions 54, 55 necessarily abut against the stoppers 124, 125 when the guide objective section 44 is moved in the groove 115.

As shown in FIG. 7, the third inclined surface 59 of the protrusion 55 abuts against the stopper 125. The third inclined surface 128 or the distal end of the stopper 125 abuts against the protrusion 55. As a result of the abutment between the protrusion 55 and the stopper 125, the ink cartridge 30 is moved in the direction of an arrow 102 in the horizontal direction (the width direction 51) which is perpendicular to the insertion/removal direction 50. Because the guide objective section 44 of the ink cartridge 30 is positioned in the groove 115, the ink cartridge 30 is moved in the direction of the arrow 102 within a range of the clearance between the guide objective section 44 and the groove 115.

The distance between the distal ends of the stoppers 124, 125 in the horizontal direction (the width direction 51) which is perpendicular to the insertion/removal direction 50 is greater than the width of the guide objective section 44 including the distal end of the protrusion 54 or the protrusion 55 in the width direction 51. Therefore, the guide objective section 44 is moved in the direction of the arrow 102 in the width direction 51 in the groove 115, and then the protrusion 55 passes through the space between the stoppers 124, 125.

Figure 8:
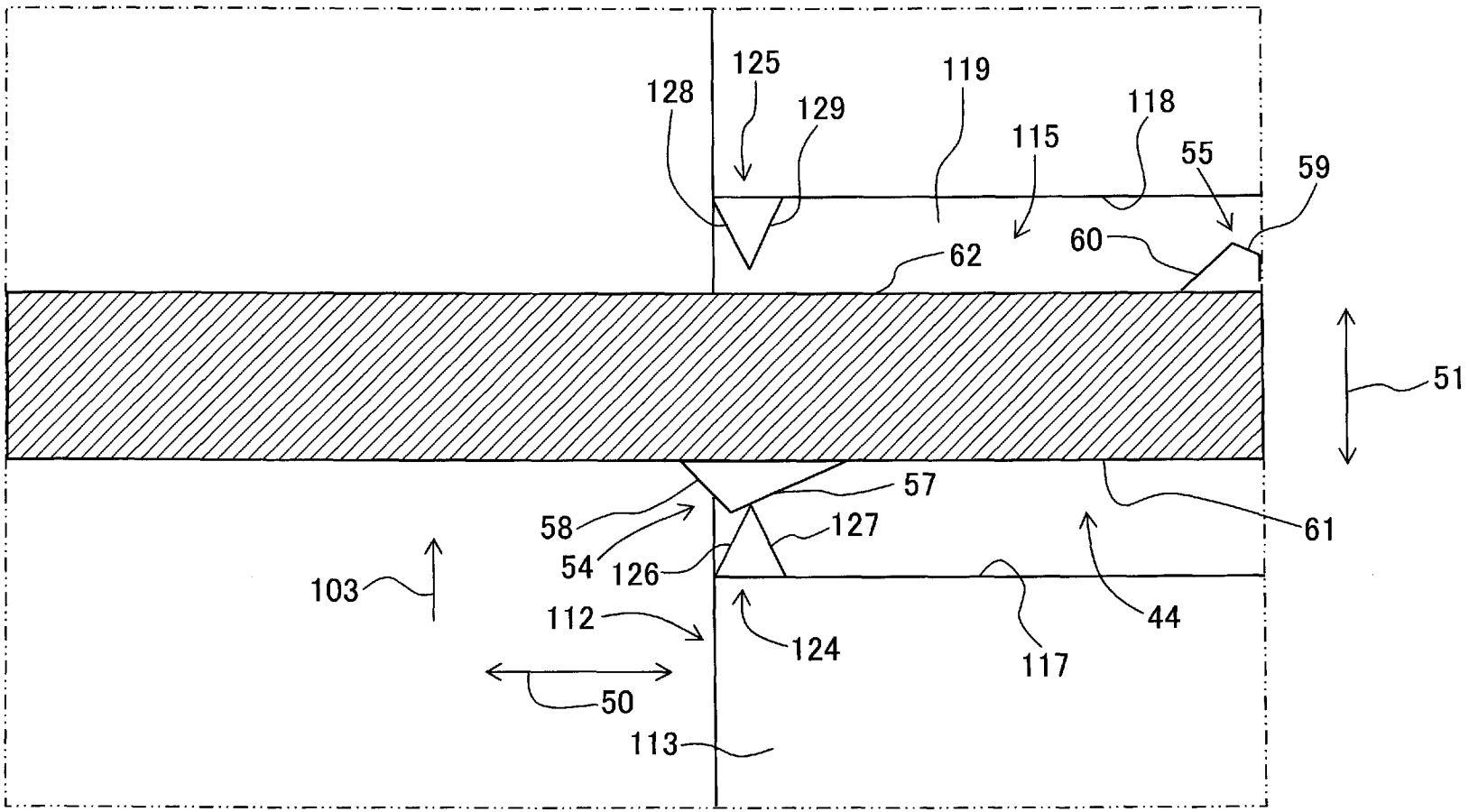
FIG. 8 is an enlarged view of the ink cartridge and the cartridge installing section of the first embodiment in the vicinity of the protrusions of the ink cartridge and the stoppers of the cartridge installing section when the ink cartridge is further inserted into the cartridge installing section from the state shown in FIG. 7.

As shown in FIG. 8, the first inclined surface 57 of the protrusion 54 abuts against the stopper 124. The first inclined surface 126 or the distal end of the stopper 124 abuts against the protrusion 54. As a result of the abutment between the protrusion 54 and the stopper 124, the ink cartridge 30 is moved in the direction of an arrow 103 in the horizontal direction (width direction 51) which is perpendicular to the insertion/removal direction 50.

The distance between the distal ends of the stoppers 124, 125 in the horizontal direction (the width direction 51) which is perpendicular to the insertion/removal direction 50 is greater than the width of the guide objective section 44 including the distal end of the protrusion 54 or the protrusion 55 in the width direction 51. Therefore, the guide objective section 44 is moved in the direction of the arrow 103 in the width direction 51 in the groove 115, and then the protrusion 54 passes through the space between the stoppers 124, 125. While the movement in the directions of the arrows 102, 103 is repeated as described above, the guide objective section 44 is moved in the groove 115, and thereby the ink cartridge 30 is installed in the cartridge installing section 110.

Figure 6:
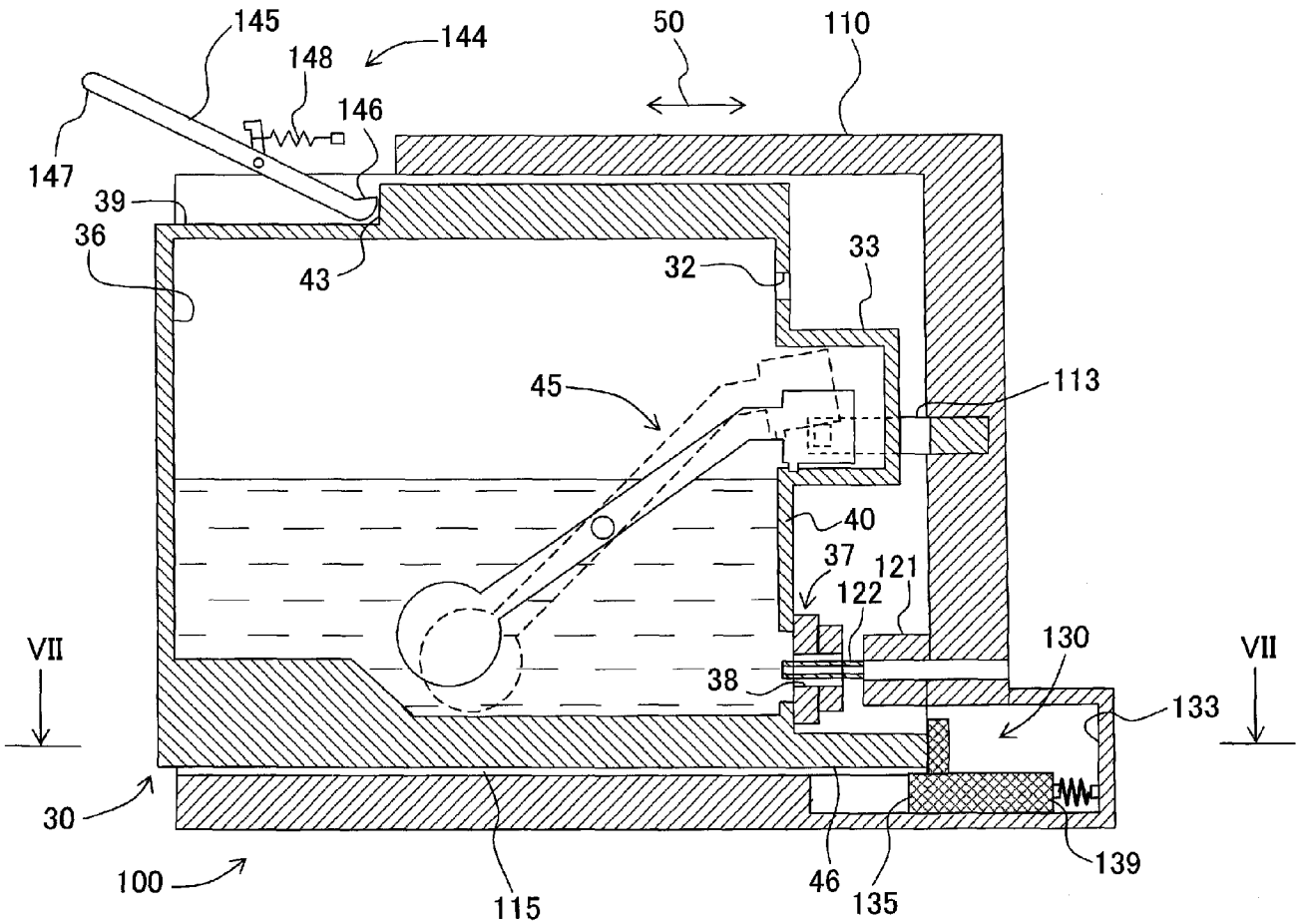
FIG. 6 is a cross-sectional view of the ink cartridge and the cartridge installing section of the first embodiment, in which the ink cartridge is installed in the cartridge installing section.

As shown in FIG. 6, when the ink cartridge 30 is inserted into the cartridge installing section 110, the slide member 135 is pressed by the projection 46 and slide toward the back wall 133 of the space 130. Further, the coil spring 139 is contracted from the natural length in accordance with the sliding of the slide member 135. When the coil spring 139 is contracted, the slide member 135 receives the urging force directed toward the opening 112 from the coil spring 139. Accordingly, the ink cartridge 30, which is in the cartridge installing section 110, is elastically urged in the removal direction 50B toward the opening 112.

During the insertion of the ink cartridge 30 into the cartridge installing section 110, the engaging end 146 of the lock lever 145 climbs onto the upper wall 39 of the ink cartridge 30. Accordingly, the lock lever 145 pivots counterclockwise (in the direction of the arrow 101 shown in FIG. 5), and the lock lever 145 is moved from the lock position to the unlock position. When the ink cartridge 30 is further inserted, then the engaging section 43 of the ink cartridge 30 is moved toward the end portion of the cartridge installing section 110 relative to the engaging end 146 of the lock lever 145, and the engaging end 146 of the lock lever 145 pivots to a position at which the engaging end 146 is engaged with the engaging section 43. That is, the lock lever 145 pivots clockwise, and the lock lever 145 is moved from the unlock position to the lock position (see FIG. 6). The ink cartridge 30, which is elastically urged by the slide member 135 and the coil spring 139, intends to move in the removal direction 50B in toward the opening 112. However, the engaging end 146 of the lock lever 145 and the engaging section 43 are engaged with each other. Therefore, the ink cartridge 30 is retained or held in the cartridge installing section 110. Accordingly, the installation of the ink cartridge 30 in the cartridge installing section 110 is completed. Further, the ink tube 122 of the connecting section 121 is inserted into the ink flow passage 38 of the ink cartridge 30 when the ink cartridge 30 is installed in the cartridge installing section 110, and ink can be supplied from the ink chamber 36 to the outside of the ink cartridge 30. When the ink tube 122 is inserted into the ink flow passage 38, the center of the guide objective section 44 in the width direction 51 is substantially aligned with the center of the groove 115 in the width direction 51.

When a user intends to remove the ink cartridge 30 from the cartridge installing section 110, the user presses the operating section 147 of the lock lever 145 downwardly. Accordingly, the lock lever 145 pivots counterclockwise such that the lock lever 145 moves from the lock position to the unlock position. When the lock lever 145 is in the unlock position, the engaging end 146 is positioned above the engaging section 43 of the ink cartridge 30. Accordingly, the engaging end 146 is separated from the engaging section 43. Therefore, the ink cartridge 30 receives the elastic urging force from the slide member 135 and the coil spring 139, and the ink cartridge 30 is moved toward the opening 112. Accordingly, the ink tube 122 of the connecting section 121 is removed from the ink flow passage 38 of the ink cartridge 30.

Figure 9:
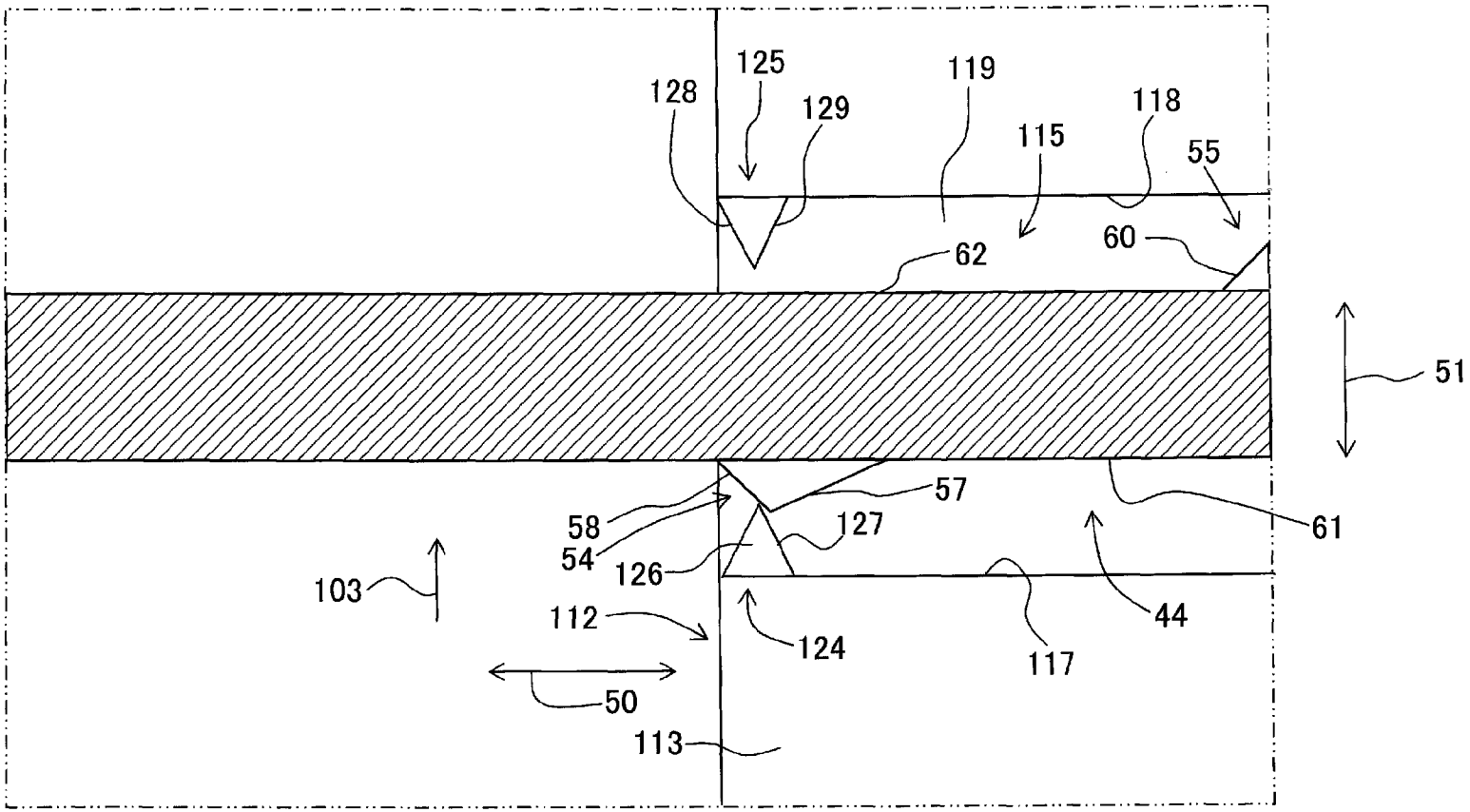
FIG. 9 is an enlarged view of the ink cartridge and the cartridge installing section of the first embodiment in the vicinity of the protrusions of the ink cartridge and the stoppers of the cartridge installing section when the ink cartridge is removed from the cartridge installing section, corresponding to a cross-sectional view taken along line VII-VII in FIG. 6.

After the coil spring 139 has returned to its natural length, as shown in FIG. 9, the protrusion 54 of the ink cartridge 30 abuts against the stopper 124. More specifically, the second inclined surface 58 of the protrusion 54 abuts against the stopper 124, and the second inclined surface 127 or the distal end of the stopper 124 abuts against the protrusion 54.

As a result of the abutment between the protrusion 54 and the stopper 124, the ink cartridge 30 is moved in the direction of the arrow 103 in the horizontal direction (the width direction 51) perpendicular to the insertion/removal direction 50. The distance between the distal ends of the stoppers 124, 125 in the width direction 51 is greater than the width of the guide objective section 44 including the distal end of the protrusion 54 or the protrusion 55 in the width direction 51. Therefore, the guide objective section 44 is moved in the direction of the arrow 103 in the width direction 51 in the groove 115, and then the protrusion 54 passes through the space between the stoppers 124, 125. The energy loss is caused by the collision between the protrusion 54 and the stopper 124, and the sliding friction between the protrusion 54 and the stopper 124 and the sliding friction between the guide objective section 44 and the groove 115 are caused, for example, in accordance with the movement of the ink cartridge 30 in the direction of the arrow 103. Accordingly, the velocity at which the ink cartridge 30 moves is attenuated or damped.

Figure 10:
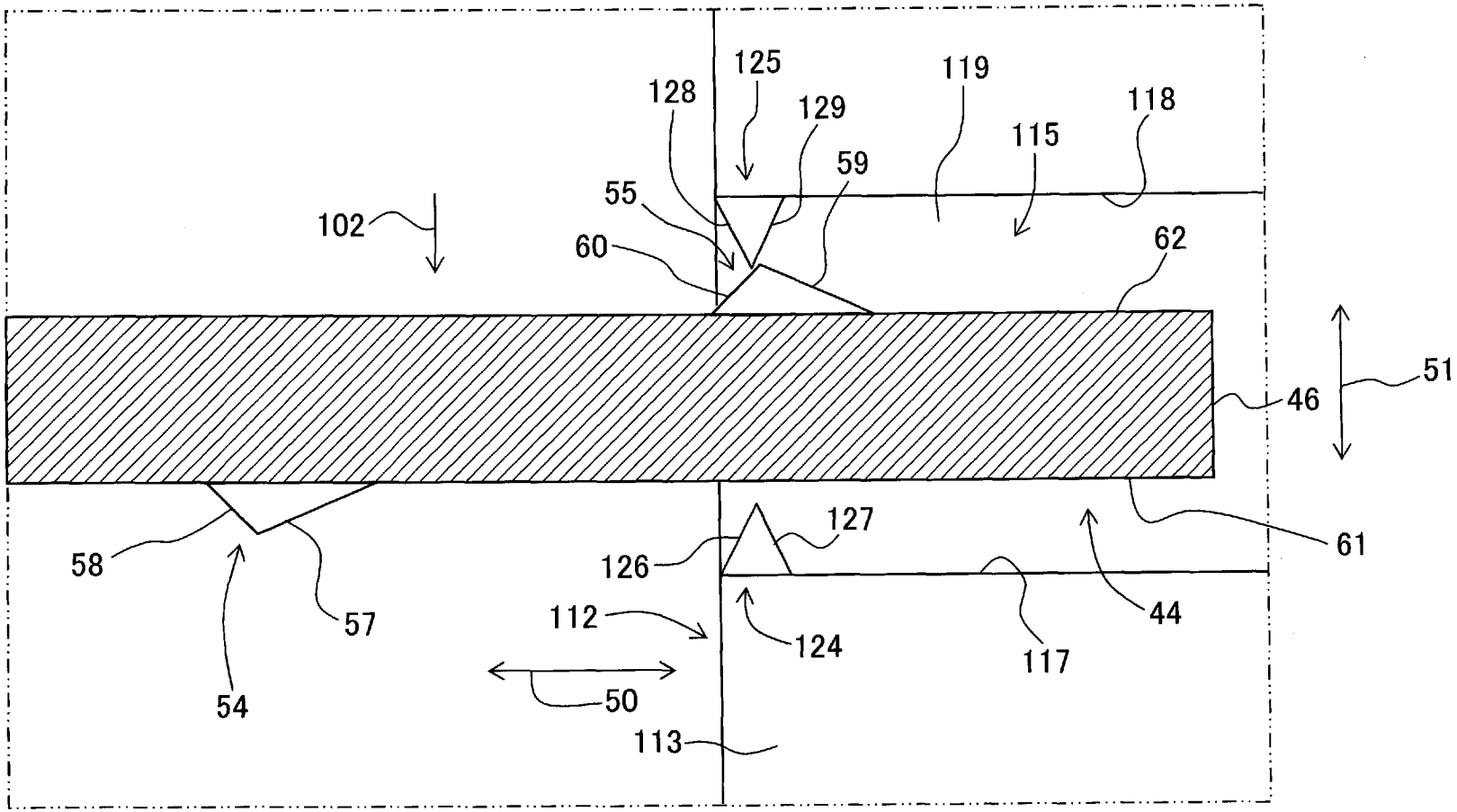
FIG. 10 is an enlarged view of the ink cartridge and the cartridge installing section of the first embodiment in the vicinity of the protrusions of the ink cartridge and the stoppers of the cartridge installing section when the ink cartridge is further removed from the cartridge installing section from the state shown in FIG. 9.

When the protrusion 54 passes through the space between the stoppers 124, 125, and the guide objective section 44 is further moved in the groove 115, then the protrusion 55 of the ink cartridge 30 abuts against the stopper 125 as shown in FIG. 10. More specifically, the fourth inclined surface 60 of the protrusion 55 abuts against the stopper 125, and the fourth inclined surface 129 or the distal end of the stopper 125 abuts against the protrusion 55.

As a result of the abutment between the protrusion 55 and the stopper 125, the ink cartridge 30 is moved in the direction of the arrow 102 in the horizontal direction (width direction 51) perpendicular to the insertion/removal direction 50. The distance between the distal ends of the stoppers 124, 125 in the width direction 51 is greater than the width of the guide objective section 44 including the distal end of the protrusion 54 or the protrusion 55 in the width direction 51. Therefore, the guide objective section 44 is moved in the direction of the arrow 102 in the width direction 51 in the groove 115, and then the protrusion 55 passes through the space between the stoppers 124, 125. The energy loss is caused by the collision between the protrusion 55 and the stopper 125, and the sliding friction between the protrusion 55 and the stopper 125 and the sliding friction between the guide objective section 44 and the groove 115 are caused, for example, in accordance with the movement of the ink cartridge 30 in the direction of the arrow 102. Accordingly, the velocity at which the ink cartridge 30 moves is attenuated or damped.

The movement of the ink cartridge 30 in the directions of the arrows 102, 103 as described above is repeated. The velocity at which the ink cartridge 30 moves by being elastically urged in the removal direction 50B toward the opening 112 is gradually attenuated or damped, and the ink cartridge 30 stops moving. After the ink cartridge 30 stops, the ink cartridge 30 is pulled out by the user from the cartridge installing section 110. The position, at which the ink cartridge 30 stops, is not limited to the position at which one of the pair of protrusions 54, 55 abuts against the stopper 124 or 125.

According to the first embodiment as described above, when the ink cartridge 30 is urged and moved toward the opening 112, the ink cartridge 30 is moved in the directions of the arrows 102, 103, while the protrusions 54, 55 of the ink cartridge 30 abut against the stoppers 124, 125, respectively. Therefore, the velocity at which the ink cartridge 30 moves is decelerated, or the ink cartridge 30 is stopped. Accordingly, it is possible to prevent the ink cartridge 30 from jumping out of the cartridge installing section 110 with a simple structure at a low cost.

Further, the first angle R1 which is formed as the acute angle between the first inclined surface 57 of the protrusion 54 and the horizontal direction (the width direction 51) perpendicular to the insertion/removal direction 50 is greater than the second angle R2 which is formed as the acute angle between the second inclined surface 58 of the protrusion 54 and the horizontal direction (the width direction 51) perpendicular to the insertion/removal direction 50. Further, the third angle R3 which is formed as the acute angle between the third inclined surface 59 of the protrusion 55 and the horizontal direction (the width direction 51) perpendicular to the insertion/removal direction 50 is greater than the fourth angle R4 which is formed as the acute angle between the fourth inclined surface 60 of the protrusion 55 and the horizontal direction (the width direction 51) perpendicular to the insertion/removal direction 50. Therefore, when the ink cartridge 30 is inserted into the cartridge installing section 110, the ink cartridge 30 is moved in the directions of the arrows 102, 103 by the first inclined surface 57 and the third inclined surface 59 which are the gentle inclined surfaces, and a user relatively gently senses the resistance brought about when the ink cartridge 30 is moved in the directions of the arrows 102, 103. The operational feeling is not significantly impaired. On the other hand, when the ink cartridge 30 is urged and moved toward the opening 112, the ink cartridge 30 is moved in the directions of the arrows 102, 103 by the second inclined surface 58 and the fourth inclined surface 60 which are the steep inclined surfaces. Therefore, the velocity at which the ink cartridge 30 moves is attenuated or damped relatively greatly.

The distal end of each of the protrusions 54, 55 is positioned inwardly from the right side surface 47 or the left side surface 48 of the main body 31. Therefore, damage and/or deformation of the protrusions 54, 55 when the ink cartridge 30 falls onto the floor, or when the ink cartridge 30 is packed in a package formed of film and the inside of the package is depressurized, is reduced or eliminated.

The lock lever 145 is configured to be engaged with the engaging section 43 of the ink cartridge 30 formed on the upper side of the ink cartridge 30 in the vertical direction (the direction of the gravity), namely on the side of the ink cartridge 30 opposite to the side on which the respective protrusions 54, 55 are disposed. Therefore, the engaging section 43 can be disposed at its location without interference with the protrusions 54, 55. Thus, the respective elements of the ink cartridge 30 may be flexibly arranged in many different configurations and embodiments.

First Modification of First Embodiment

In the first embodiment described above, protrusions 54, 55 are offset and separated in the insertion/removal direction 50 in the ink cartridge 30, and stoppers 124, 125 are disposed at the same position in relation to the insertion/removal direction 50, i.e., the stoppers 124, 125 are aligned in the horizontal direction (the width direction 51) which is perpendicular to the insertion/removal direction 50. However, the arrangement of the protrusions 54, 55 and the stoppers 124, 125 may be changed.

Figure 11:
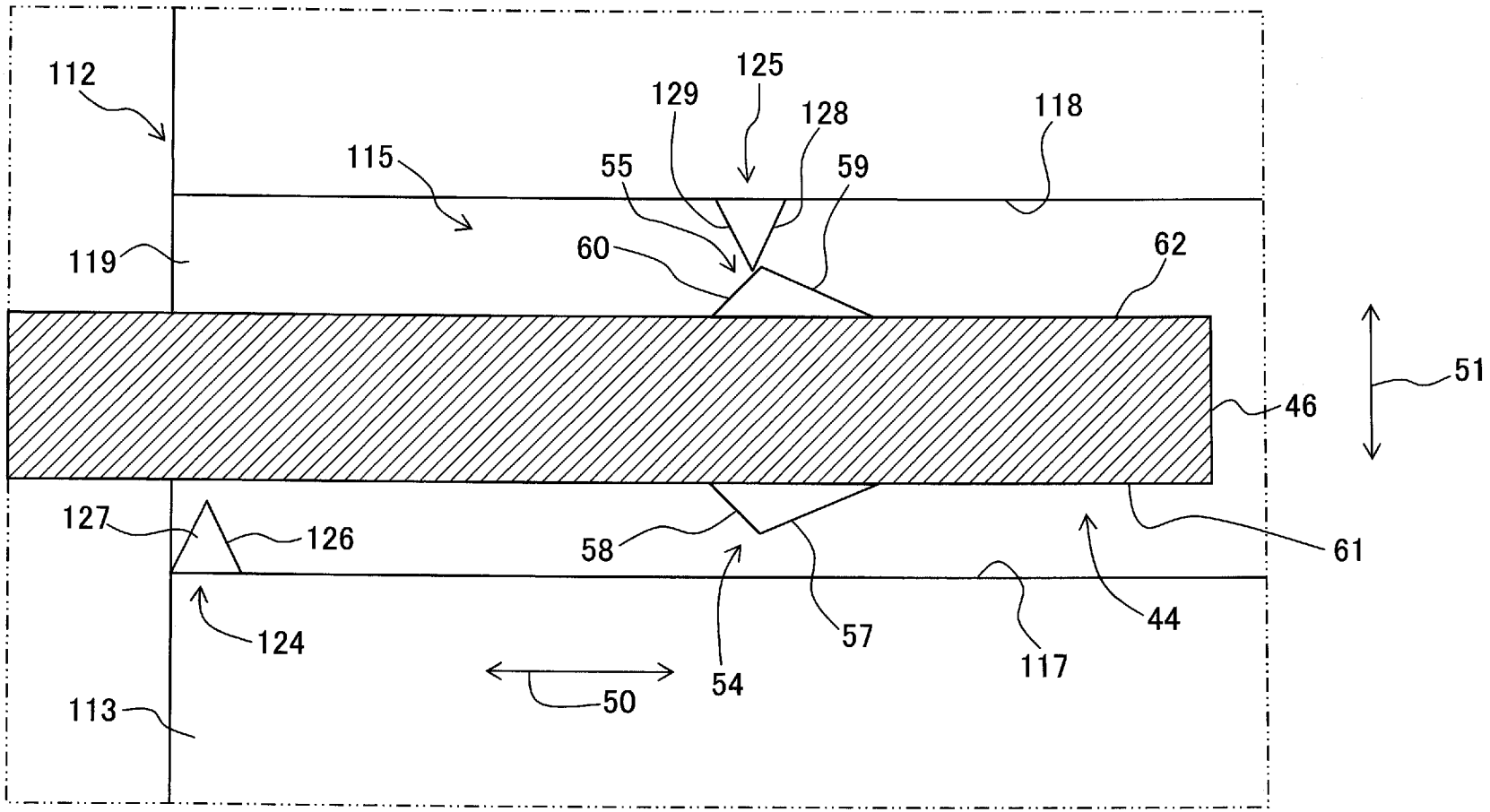
FIG. 11 is an enlarged view of an ink cartridge and a cartridge installing section of a first modification of the first embodiment in the vicinity of protrusions of the ink cartridge and stoppers of the cartridge installing section, corresponding to a cross-sectional view taken along line VII-VII in FIG. 6.

As shown in FIG. 11, the protrusions 54, 55 may be disposed on the guide objective section 44 at the same position in relation to the insertion/removal direction 50, i.e., the protrusions 54, 55 may be aligned in the horizontal direction (the width direction 51) which is perpendicular to the insertion/removal direction 50, and stoppers 124, 125 may be offset and separated from each other in the insertion/removal direction 50 in the groove 115. In this first modification of the first embodiment, the distance between the distal ends of the protrusions 54, 55 in the horizontal direction (the width direction 51) perpendicular to the insertion/removal direction 50 is greater than the distance between the distal ends of the stoppers 124, 125 in the horizontal direction (the width direction 51) perpendicular to the insertion/removal direction 50. Further, the distance between the distal ends of the protrusions 54, 55 in the horizontal direction (the width direction 51) perpendicular to the insertion/removal direction 50 is less than distance from the distal end of the stopper 124 to the side surface 118 of the groove 115 and less than the distance from the distal end of the stopper 125 to the side surface 117 of the groove 115, in the horizontal direction (the width direction 51) perpendicular to the insertion/removal direction 50. Therefore, when the guide objective section 44 is moved in the groove 115, the protrusions 54, 55 necessarily abut against the stoppers 124, 125. Further, the protrusions 54, 55 can pass through the interior of the groove 115 at the position at which the stopper 124 or the stopper 125 is provided. In this first modification of the first embodiment, the effect, which is the same as or equivalent to that obtained in the first embodiment, is provided.

Second Modification of First Embodiment

Figure 12:
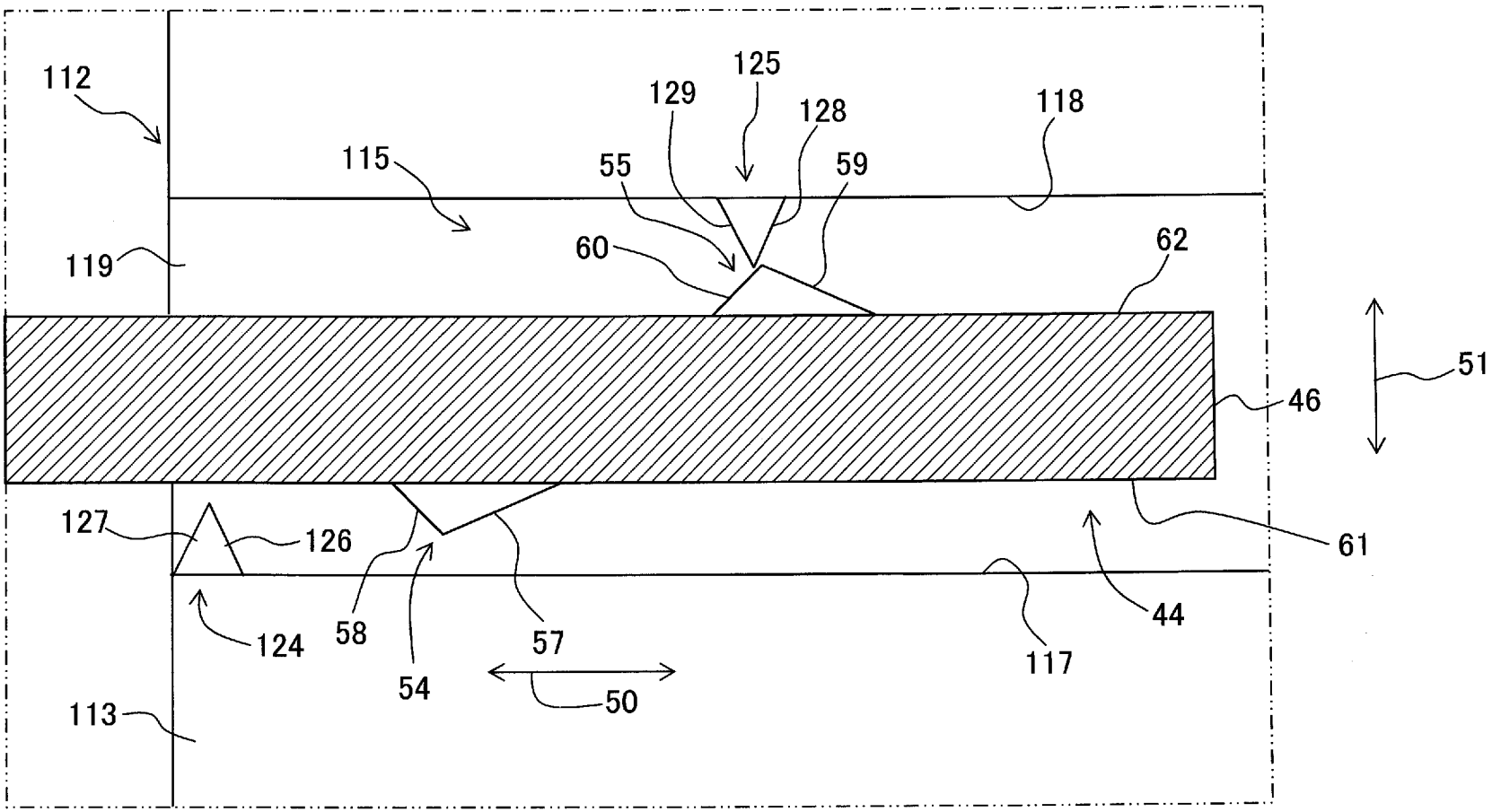
FIG. 12 is an enlarged view of an ink cartridge and a cartridge installing section of a second modification of the first embodiment in the vicinity of protrusions of the ink cartridge and stoppers of the cartridge installing section, corresponding to a cross-sectional view taken along line VII-VII in FIG. 6.

As shown in FIG. 12, according to a second modification of the first embodiment, protrusions 54, 55 of the guide objective section 44 may be offset and separated from each other in the insertion/removal direction 50, and stoppers 124, 125 may be off set and separated from each other in the insertion/removal direction 50 in the groove 115. In this second modification of the first embodiment, the protrusion 54 is positioned closer to the opening 112 than the protrusion 55 is when the ink cartridge 30 is installed in the cartridge installing section 110. In the groove 115, the stopper 124 is positioned closer to the opening 112 than the stopper 125 is. The distance between the distal ends of the protrusions 54, 55 in the insertion/removal direction 50 is less than the distance between the distal ends of the stoppers 124, 125 in the insertion/removal direction 50. In this second modification of the first embodiment, the effect, which is the same as or equivalent to that obtained in the first embodiment, is provided. Further, the occurrence of such a situation is avoided that the timing at which the protrusion 54 abuts against the stopper 124 is simultaneous with the timing at which the protrusion 55 abuts against the stopper 125.

The distance between the distal ends of the protrusions 54, 55 in the insertion/removal direction 50 may be greater than the distance between the distal ends of the stoppers 124, 125 in the insertion/removal direction 50 as long as the stopper 124 is positioned between the opening 112 and the protrusion 54 and the stopper 125 is positioned between the opening 112 and the protrusions 55 when the ink cartridge 30 is installed in the cartridge installing section 110.

Third Modification of First Embodiment

Figure 13:
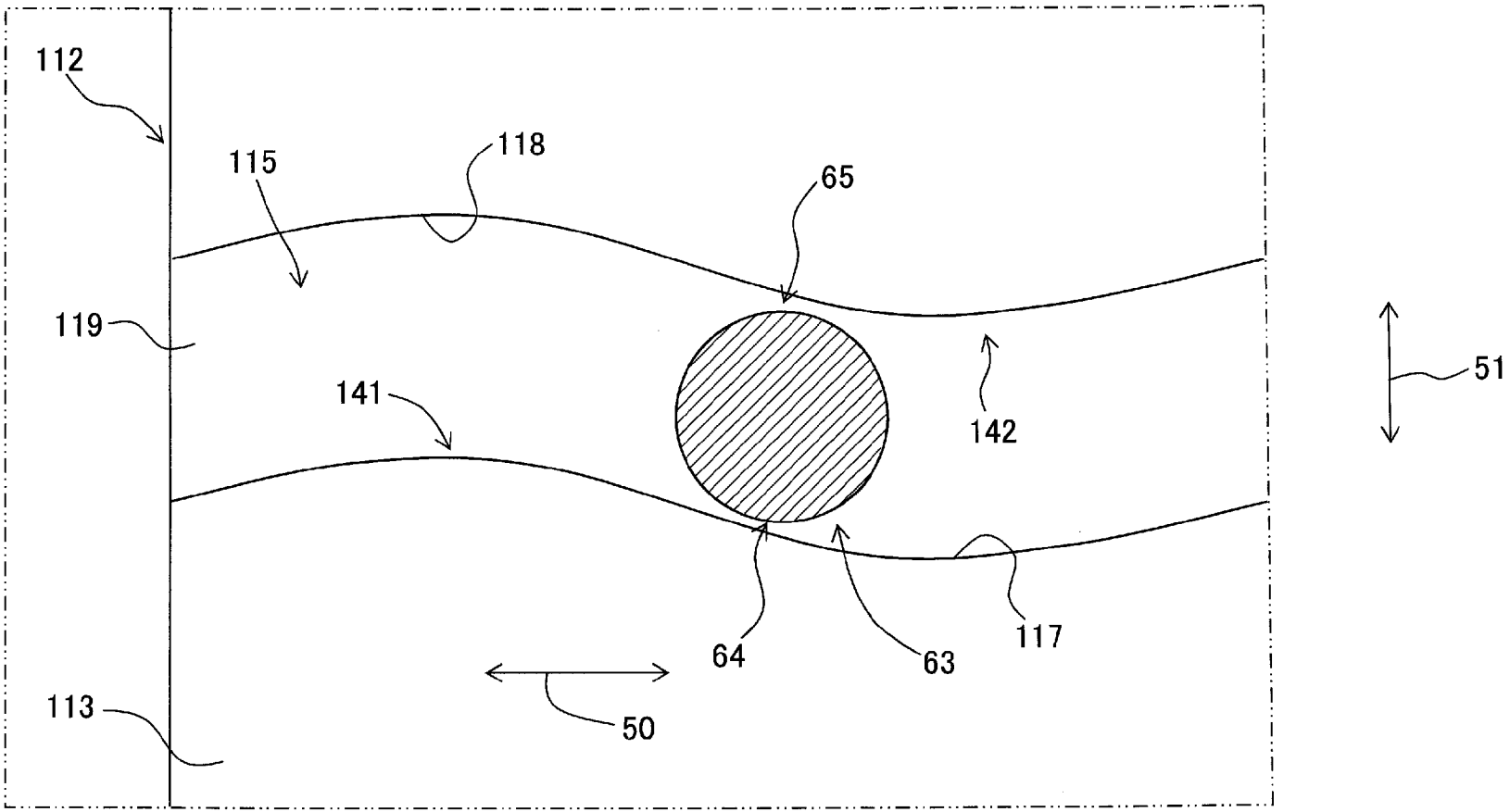
FIG. 13 is an enlarged view of an ink cartridge and a cartridge installing section of a third modification of the first embodiment in the vicinity of protrusions of the ink cartridge and stoppers of the cartridge installing section, corresponding to a cross-sectional view taken along line in FIG. 6.

The stoppers 124, 125, which have the shapes provided with the surfaces intersecting the side surfaces 117, 118 of the groove 115, are described in the first embodiment and the respective modifications thereof. However, as shown in FIG. 13, according to a third modification of the first embodiment, stopper 141, 142 may be formed by smooth curved surfaces extending continuously from side surfaces 117, 118 of the groove 115. More specifically, a portion of the side surface 117, which protrudes (curves) toward the side surface 118, functions as the stopper 141, and a portion of the side surface 118, which protrudes (curves) toward the side surface 117, functions as the stopper 142. The stoppers 141, 142 are offset and separated from each other in the insertion/removal direction 50 in the groove 115. As a result, the groove 115 as a whole is curved in an S-shaped form with respect to the insertion/removal direction 50.

A guide objective section 63 of the ink cartridge 30 does not extend in the depth direction 53 unlike the guide objective section 44 described above. The guide objective section 63 comprises a boss, which has a circular cross section in a horizontal plane, may extend downwardly from the lower wall 41 of the main body 31 (see FIG. 2). Of the guide objective section 63 having the columnar shape as described above, a portion, which faces the side surface 117 of the groove 115, functions as a protrusion 64 to abut against the stopper 141 such that the ink cartridge 30 is moved in the width direction 51, and a portion, which faces the side surface 118, functions as a protrusion 65 to abut against the stopper 142 such that the ink cartridge 30 is moved in the width direction 51.

When the guide objective section 63 is inserted into the groove 115, and the ink cartridge 30 is moved in the insertion/removal direction 50, the guide objective section 63 is moved in the width direction 51 by the stoppers 141, 142. During the movement, the sliding friction is caused between the guide objective section 63 and the groove 115. The velocity at which the ink cartridge 30 moves is decelerated or the ink cartridge 30 is stopped, similarly to the first embodiment. Accordingly, it is possible to prevent the ink cartridge 30 from jumping out of the cartridge installing section 110 with a simple structure at a low cost.

In the first embodiment and the first and second modification thereof, the inclined surfaces, which are inclined with respect to the horizontal direction perpendicular to the insertion/removal direction 50, are provided for both of the protrusions 54, 55 and the stoppers 124, 125. However, the inclined surfaces may not be provided for both of the pair of respective protrusions 54, 55 and the pair of stoppers 124, 125. For example, the inclined surface may be provided for one of the pair of protrusions 54, 55 and the pair of stoppers 124, 125, and any various shapes may be adopted for the other pair such that the ink cartridge 30 may be moved in the width direction 51 with the inclined surfaces. The respective inclined surfaces may not be planar surfaces. The respective inclined surfaces may be curved surfaces or spherical surfaces.

In the first embodiment and the first and second modifications thereof, the two protrusions 54, 55 or the two stoppers 124, 125 are provided being offset in the insertion/removal direction 50. However, the number of the protrusions or the stoppers provided being offset in the insertion/removal direction 50 is not limited to two in the present invention. It is also allowable to provide three or more protrusions and/or stoppers.

In the first embodiment and the first and second modifications thereof, the first angle R1 which is formed as the acute angle between the first inclined surface 57 and the horizontal direction (the width direction 51) perpendicular to the insertion/removal direction 50 is greater than the second angle R2 which is formed as the acute angle between the second inclined surface 58 and the horizontal direction (the width direction 51) perpendicular to the insertion/removal direction 50, and the third angle R3 which is formed between the third inclined surface 59 and the horizontal direction (the width direction 51) perpendicular to the insertion/removal direction, is greater than the fourth angle R4 which is formed as the acute angle between the fourth inclined surface 60 and the horizontal direction (the width direction 51) perpendicular to the insertion/removal direction 50. However, for example, the degree of the first angle R1 may equal to the degree of the second angle R2, and the degredd of the third angle R3 may equal to the degree of the fourth angle R4. In this case, for example, a surface treatment may be applied to the first inclined surface and the second inclined surface such that the coefficient of friction between the second inclined surface 58 and the stopper 124 is greater than the coefficient of friction between the first inclined surface 57 and the stopper 124, and the surface treatment may be applied to the third inclined surface and the fourth inclined surface so that the coefficient of friction between the fourth inclined surface 60 and the stopper 125 is greater than the coefficient of friction between the third inclined surface 59 and the stopper 125.

Second Embodiment

In the second embodiment, the position at which the protrusion of the ink cartridge 30 is provided and the direction in which the protrusion protrudes, and the position at which the stopper of the cartridge installing section 110 is provided and the direction in which the stopper protrudes, are different from those in the first embodiment, respectively. Therefore, those positions and the directions will be explained in detail below.

Figure 14:
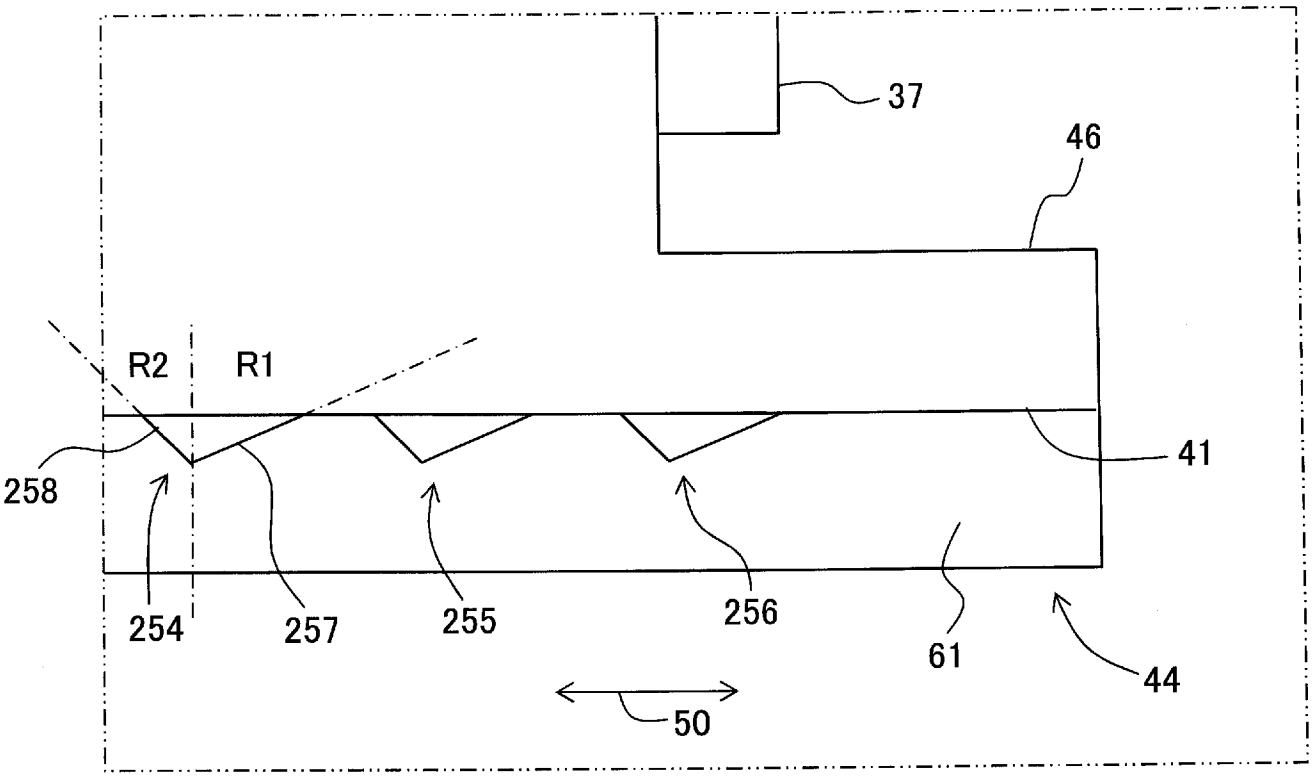
FIG. 14 is an enlarged side view of an ink cartridge of a second embodiment in the vicinity of protrusions of the ink cartridge.

As shown in FIG. 14, similarly to the first embodiment, the guide objective section 44, which extends in the depth direction 53, is provided on the lower wall 41 of the main body 31 of the ink cartridge 30. The guide objective section 44 protrudes downwardly from the lower wall 41. The guide objective section 44 comprises the surface 61 and the surface 62 opposite the surface 61 in the width direction 51. Each of the surface 61 and the surface 62 extends in the height direction 52 and the depth direction 53. The surfaces 61, 62 are positioned more inside than the right side surface 47 and the left side surface 48 of the main body 31 in the width direction 51. When the ink cartridge 30 is inserted into and removed from the installing section 110, the guide objective section 44 is inserted into and move in the groove 115. The surfaces 61, 62 faces the side surfaces 117, 118 of the groove 115, which partially define the groove 115. The lower wall 41, which extends in the insertion/removal direction 50 on the both left and right sides of the guide objective section 44, is an example of a fourth surface. The lower wall 41 faces downward in the vertical direction (the direction of the gravity) when the ink cartridge 30 is inserted into or removed from the cartridge installing section 110.

As shown in FIG. 14, three protrusions 254, 255, 256 protrude downwardly in the vertical direction (the direction of the gravity) from the lower wall 41 on the right side surface 47 side of the guide objective section 44. The three protrusions 254, 255, 256 have the same shape except that they are disposed at different positions in the depth direction 53. The three protrusions 254, 255, 256 are disposed at predetermined intervals in the insertion/removal direction 50. The respective protrusions 254, 255, 256 are configured to abut against a stopper 226 described later when the ink cartridge 30 is removed from the cartridge installing section 110.

Although not shown in the respective drawings, three protrusions, which are equivalent to the protrusions 254, 255, 256 described above, are also provided on the lower wall 41 on the left side surface 48 side of the guide objective section 44. The three protrusions form pairs with the protrusions 254, 255, 256, respectively, on both sides of the guide objective section 44 in the horizontal direction (the width direction 51) perpendicular to the insertion/removal direction 50. In other words, the three protrusions are aligned with the protrusions 254, 255, 256 in the horizontal direction (the width direction 51) perpendicular to the insertion/removal direction 50. The three protrusions are configured to abut against a stopper 227 described later when the ink cartridge 30 is removed from the cartridge installing section 110.

As described above, the respective protrusions 254, 255, 256 have the same shape except that they are disposed in different positions. Therefore, the shape of the protrusion 254 will be explained in detail, representing the protrusions 254, 255, 256. The protrusion 254 has a first guide surface 257 which is positioned on the front wall 40 side of the protrusion 254 and which faces obliquely downward, and a second guide surface 258 which is positioned on the back wall 42 side of the protrusion 254 and which faces obliquely downward. The first guide surface 257 and the second guide surface 258 are formed continuously in the insertion/removal direction 50. The protrusion 254 has an inverted triangular shape as viewed in a side view. Therefore, the first guide surface 257 is configured to abut against the stopper 226 described later to guide the ink cartridge 30 upwardly in the vertical direction (the direction of the gravity) when the ink cartridge 30 is inserted into the cartridge installing section 110. The second guide surface 258 is configured to abut against the stopper 226 described later to guide the ink cartridge 30 upwardly in the vertical direction (the direction of the gravity) when the ink cartridge 30 is removed from the cartridge installing section 110.

Each of the first guide surface 257 and the second guide surface 258 is a planar surface which is inclined with respect to the vertical direction (the direction of the gravity). However, the first guide surface 257 and the second guide surface 258 have different angles of inclination with respect to the vertical direction (the direction of the gravity). The first angle R1 which is formed as an acute angle between the first guide surface 257 and the vertical direction (the direction of the gravity) is greater than the second angle R2 which is formed as an acute angle between the second guide surface 258 and the vertical direction (the direction of the gravity). In other words, the first guide surface 257 is a gentle inclined surface, and the second guide surface 258 is a steep inclined surface.

Figure 15:
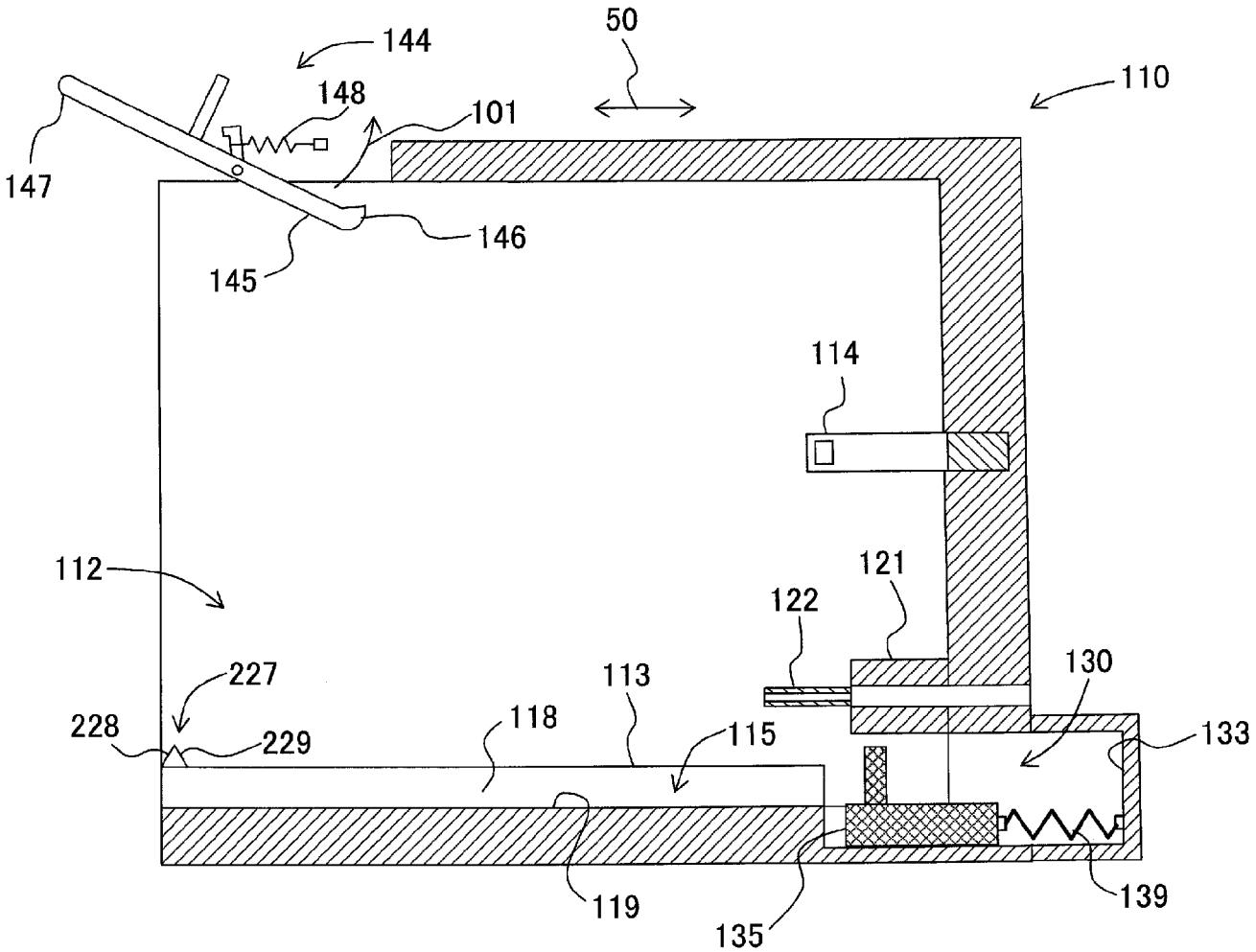
FIG. 15 is a cross-sectional view of a cartridge installing section of the second embodiment.
Figure 16:
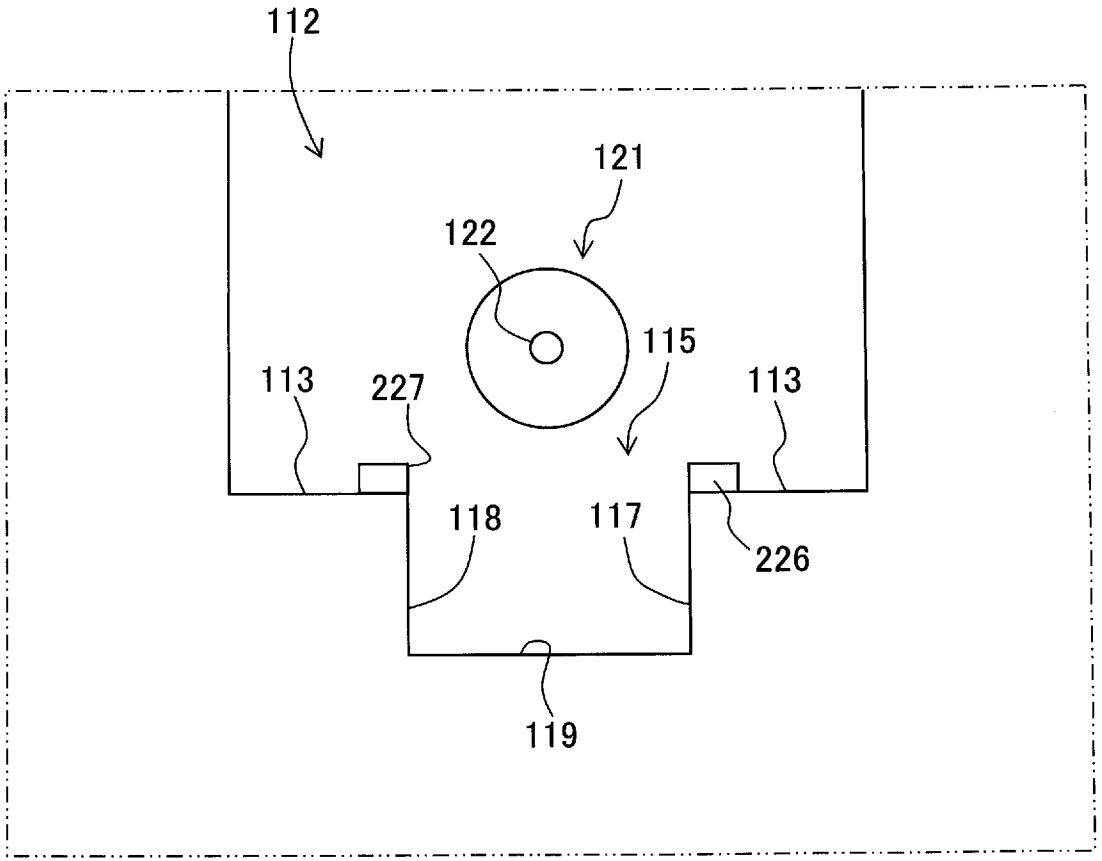
FIG. 16 is an enlarged front view of the cartridge installing section of the second embodiment in the vicinity of stoppers.

Next, the cartridge installing section 110 will be explained with reference to FIG. 15. Similarly to the first embodiment, the cartridge installing section 110 has the groove 115 formed in the bottom surface 113 which defines the bottom portion of the inner space of the cartridge installing section 110. The groove 115 extends from the opening 112 to the end portion of the cartridge installing section 110 in the insertion direction 50A. As shown in FIG. 16, the groove 115 is defined by the pair of side surfaces 117, 118 and the bottom surface 119 which connects the side surfaces 117, 118. The groove 115 extends to the bottom surface 119 downwardly in the vertical direction from the bottom surface 113. The side surfaces 117, 118 are opposed to one another and extend in the insertion/removal direction 50. Each of the bottom surfaces 113, 119 is faces upward in the vertical direction (the direction of the gravity). The bottom surface 113 is an example of a third surface. The side surface 117 is not shown in FIG. 15.

The pair of stoppers 226, 227 is provided on the bottom surface 113 on both sides of the groove 115, respectively, adjacent to the opening 112. The stoppers 226, 227 protrude upwardly in the vertical direction (the direction of the gravity) from the bottom surface 113.

The stoppers 226, 227 have the same shape except that they are differently arranged. Therefore, the shape of the stopper 226 will be explained, representing the stoppers 226, 227. The stopper 226 comprises a first guide surface 228 which is positioned on the opening 112 side of the stopper 226 and which is faces obliquely upward, and a second guide surface 229 which is positioned on the end portion (of the cartridge installing section 110 provided with the optical sensor 114 and the connecting section 121) side of the stopper 226 and which is faces obliquely upward. The first guide surface 228 and the second guide surface 229 are formed continuously in the insertion/removal direction 50. The stopper 226 has a triangular shape as viewed in a side view (see FIG. 17). Therefore, the first guide surface 228 abuts against the protrusions 254, 255, 256 to guide the ink cartridge 30 upwardly in the vertical direction (the direction of the gravity) when the ink cartridge 30 is inserted into the cartridge installing section 110. The second guide surface 229 abuts against the protrusions 254, 255, 256 to guide the ink cartridge 30 upwardly in the vertical direction (the direction of the gravity) when the ink cartridge 30 is removed from the cartridge installing section 110. Each of the first guide surface 228 and the second guide surface 229 is a planar surface which is inclined with respect to the vertical direction (the direction of the gravity).

The ink cartridge 30 is inserted into the cartridge installing section 110 via the opening 112 with the front wall 40 facing forward in the insertion direction 50A, similarly to the first embodiment. When the ink cartridge 30 is inserted into the cartridge installing section 110, the guide objective section 44 of the ink cartridge 30 is inserted into the groove 115 of the cartridge installing section 110. The ink cartridge 30 is guided in the insertion/removal direction 50 by the contact between the guide objective section 44 and the groove 115.

Figure 17:
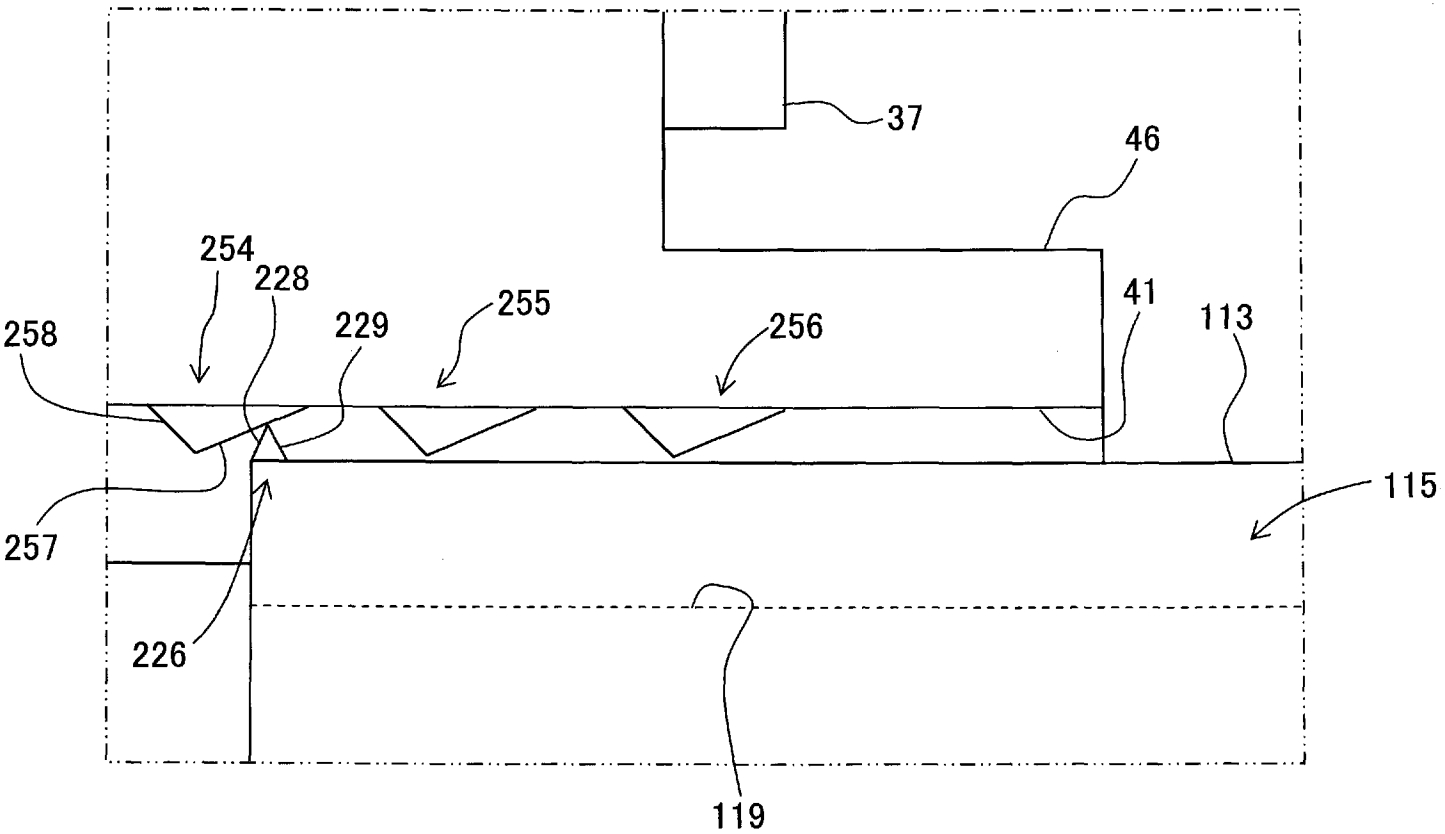
FIG. 17 is an enlarged view of the ink cartridge and the cartridge installing section of the second embodiment in the vicinity of the protrusions of the ink cartridge and the stopper of the cartridge installing section when the ink cartridge is inserted into the cartridge installing section.

The protrusions 254, 255, 256 and the three protrusions which form the pairs with the protrusions 254, 255, 256, respectively, abut against the stoppers 226, 227, respectively, during the insertion of the ink cartridge 30 into the cartridge installing section 110. As shown in FIG. 17, for example, the first guide surface 257 of the protrusion 254 abuts against the stopper 226, and the first guide surface 228 of the stopper 226 abuts against the protrusion 254. In accordance with the abutment between the protrusion 254 and the stopper 226, the ink cartridge 30 is guided upwardly in the vertical direction (the direction of the gravity). When the protrusion 254 climbs over the peak of the stopper 226, the ink cartridge 30 is moved back downwardly in the vertical direction (the direction of the gravity) due to the gravity. The upward/downward movement as described above is repeated every time when the protrusions 254, 255, 256 and the three protrusions which form the pairs with the protrusions 254, 255, 256, respectively, climbs over the stoppers 226, 227.

Figure 18:
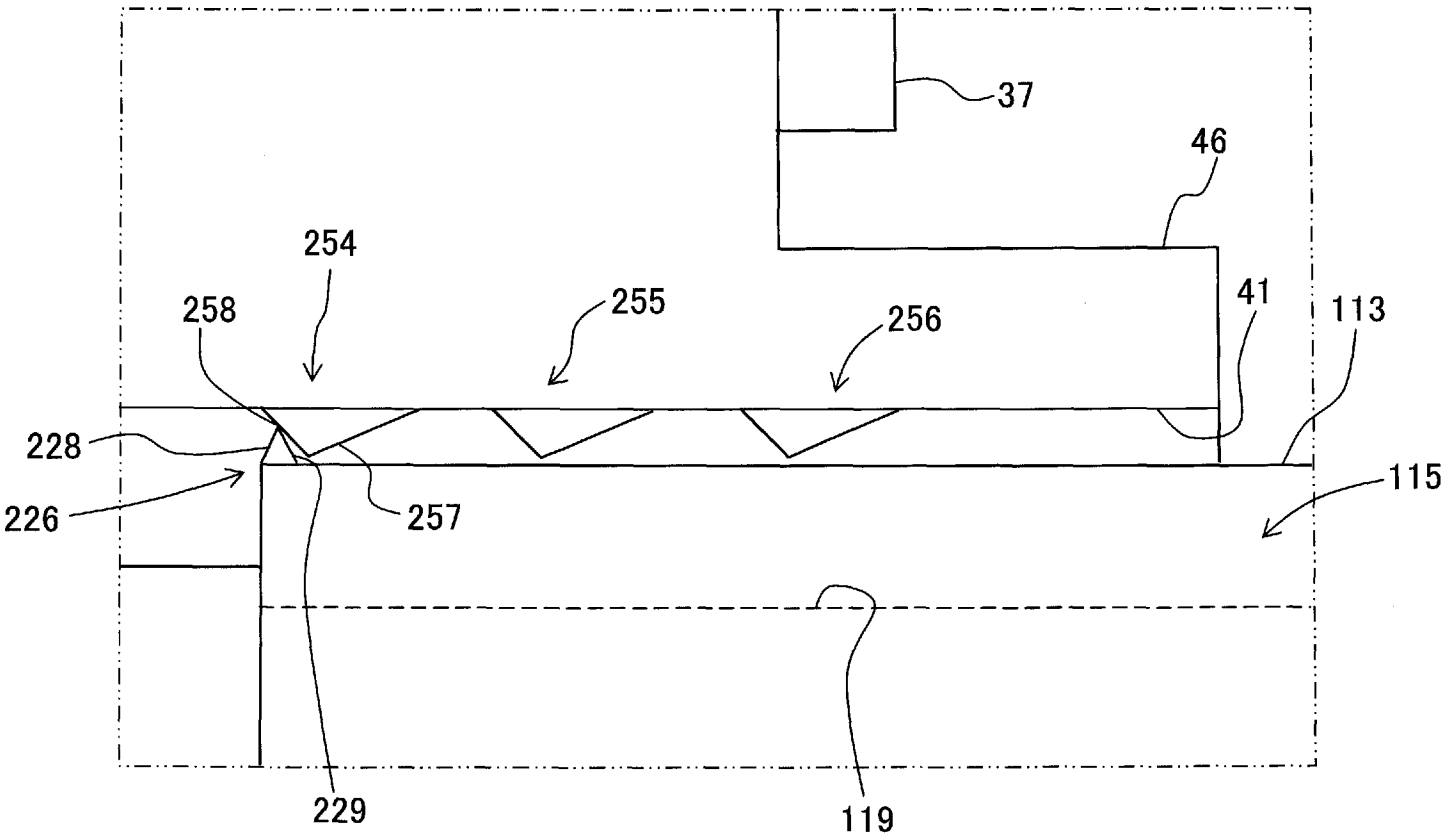
FIG. 18 is an enlarged view of the ink cartridge and the cartridge installing section of the second embodiment in the vicinity of the protrusions of the ink cartridge and the stopper of the cartridge installing section when the ink cartridge is removed from the cartridge installing section.

As shown in FIG. 18, the protrusion 254 of the ink cartridge 30 abuts against the stopper 226 when the ink cartridge 30 is removed from the cartridge installing section 110. Although not shown in FIG. 18, the protrusion, which forms the pair with the protrusion 254 abuts against the stopper 227. The second guide surface 258 of the protrusion 254 abuts against the stopper 226, and the second guide surface 229 of the stopper 226 abuts against the protrusion 254.

In accordance with the abutment between the protrusion 254 and the stopper 226, the ink cartridge 30 is guided upwardly in the vertical direction (the direction of the gravity). If the velocity at which the ink cartridge 30 moves toward the opening 112 is fast, the ink cartridge 30 is further moved even after the protrusion 254 has climbed over the stopper 226. However, when the protrusion 254 climbed over the stopper 226, the velocity of the ink cartridge 30 is attenuated or damped.

When the protrusion 254 climbs over the peak of the stopper 226, the ink cartridge 30 is moved back downwardly due to the gravity. Subsequently, the protrusion 255 abuts against the stopper 226. The ink cartridge 30 is guided upwardly in the vertical direction (the direction of the gravity) in accordance with the abutment between the protrusion 255 and the stopper 226 in the same manner as in the abutment between the protrusion 254 and the stopper 226. If the velocity at which the ink cartridge 30 moves toward the opening 112 is fast, the ink cartridge 30 is further moved even after the protrusion 255 has climbed over the stopper 226. However, when the protrusion 255 climbs over the stopper 226, the velocity of the ink cartridge 30 is further attenuated or damped.

When the protrusion 255 climbs over the peak of the stopper 226, the ink cartridge 30 is moved back downwardly due to the gravity. Subsequently, the protrusion 256 abuts against the stopper 226. The ink cartridge 30 is guided upwardly in the vertical direction (the direction of the gravity) in accordance with the abutment between the protrusion 256 and the stopper 226 in the same manner as in the abutment between the protrusion 254 and the stopper 226. If the velocity at which the ink cartridge 30 moves toward the opening 112 is fast, the ink cartridge 30 is further moved even after the protrusion 256 has climbed over the stopper 226. However, when the protrusion 256 climbs over the stopper 226, the velocity of the ink cartridge 30 is further attenuated or damped.

The velocity at which the ink cartridge 30 moves by being elastically urged in the removal direction 50B toward the opening 112 is gradually attenuated or damped in accordance with the abutments between the stoppers 226, 227 and the protrusions 254, 255, 256 and the three protrusions which form the pairs with the protrusions 254, 255, 256 respectively, and then the ink cartridge 30 stops. After the ink cartridge 30 stops, the ink cartridge 30 is pulled out by a user from the cartridge installing section 110. The position, at which the ink cartridge 30 stops, is not limited to the position at which one of the pairs of protrusions 254, 255, 256 abut against the stoppers 226, 227.

According to the second embodiment described above, the stoppers 226 227 repeatedly abut against the protrusions 254, 255, 256 and the three protrusions which form the pairs with the protrusions 254, 255, 256 of the ink cartridge 30 moved along the groove 115, respectively, when the ink cartridge 30 is urged and moved toward the opening 112. Therefore, the velocity at which the ink cartridge 30 moves is decelerated, or the ink cartridge 30 is stopped. Accordingly, it is possible to prevent the ink cartridge 30 from jumping out of the cartridge installing section 110 with a simple structure at a low cost.

The first angle R1 which is formed as the acute angle between the first guide surface 257 (of the protrusions 254, 255, 256 and the three protrusions which form the pairs with the protrusions 254, 255, 256 respectively) and the vertical direction (the direction of the gravity) is greater than the second angle R2 which is formed as the acute angle between the second guide surface 258 and the vertical direction (the direction of the gravity) Therefore, when the ink cartridge 30 is inserted into the cartridge installing section 110, the ink cartridge 30 is guided upwardly in the vertical direction (the direction of the gravity) by the first guide surface 257 which is the gentle inclined surface. A user relatively gently senses the resistance when the ink cartridge 30 is lifted upwardly in the vertical direction (the direction of the gravity), and the operational feeling is not significantly impaired. On the other hand, when the ink cartridge 30 is urged and moved toward the opening 112, the ink cartridge 30 is guided upwardly in the vertical direction (the direction of the gravity) by the second guide surface 258 which is the steep inclined surface. Therefore, the velocity at which the ink cartridge 30 moves is attenuated or damped relatively greatly.

The pair of stoppers 226, 227 are provided on both sides of the groove 115 in the horizontal direction perpendicular to the insertion/removal direction 50. The pair of each of the protrusions 254, 255, 256 and each of the three protrusions which form the pairs with the protrusions 254, 255, 256, respectively, are provided on, both sides of the guide objective section 44 in the horizontal direction perpendicular to the insertion/removal direction. Therefore, the stoppers 226, 227 abut against each of the protrusions 254, 255, 256 and each of the three protrusions which form the pairs with the protrusions 254, 255, 256, respectively, substantially simultaneously on both left and right sides of the ink cartridge 30. The velocity at which the ink cartridge 30 moves is attenuated or damped more greatly. Further, even when the ink cartridge 30 stops at the position at which the stoppers 226, 227 abut against one of the protrusions 254, 255, 256 and one of the three protrusions which form the pairs with the one of the protrusions 254, 255, 256, the ink cartridge 30 is not inclined toward the left or right side with respect to the vertical direction (the direction of the gravity). Therefore, it is easy to take the ink cartridge 30 out of the cartridge installing section 110.

The lock lever 145 is configured to be engaged with the engaging section 43 of the ink cartridge 30 formed on the upper side of the ink cartridge in the vertical direction (the direction of the gravity), on the side of the ink cartridge opposite to the side on which the protrusions 254, 255, 256 and the three protrusions which form the pairs with the protrusions 254, 255, 256, respectively, are disposed. Therefore, the engaging section 43 can be disposed at its location without interference with the protrusions 254, 255, 256 and the three protrusions which form the pairs with the protrusions 254, 255, 256, respectively. Thus, the respective elements of the ink cartridge 30 may be flexibly arranged in many different configurations and embodiments.

Modification

In the second embodiment described above, the respective protrusions 254, 255, 256 protrude downwardly in the vertical direction (the direction of the gravity) from the lower wall 41 of the ink cartridge 30, and the stoppers 226, 227 protrude upwardly in the vertical direction (the direction of the gravity) from the bottom surface 113 of the cartridge installing section 110, respectively. However, the arrangement and the protruding directions of the respective protrusions 254, 255, 256 and the stoppers 226, 227 may be changed.

Figure 19:
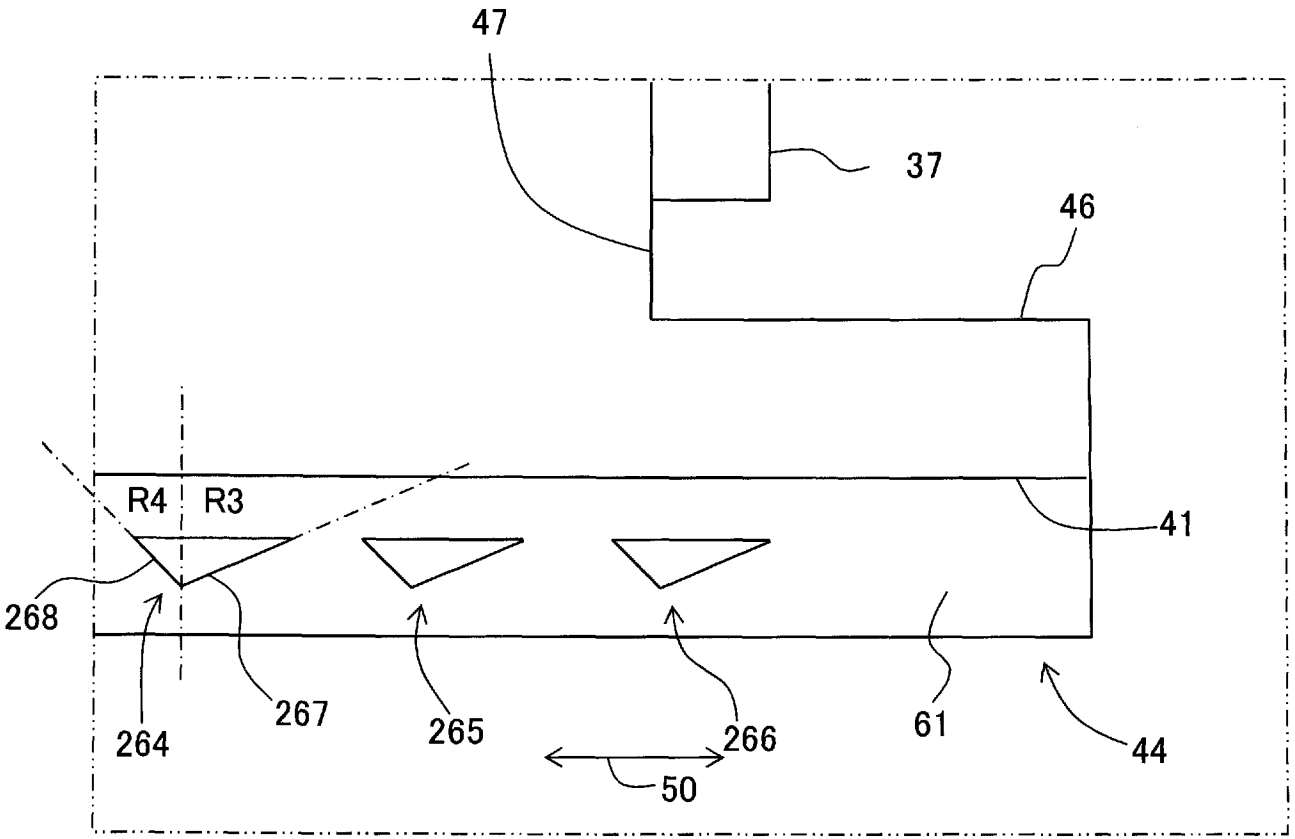
FIG. 19 is an enlarged side view of an ink cartridge of a modification of the second embodiment in the vicinity of protrusions of the ink cartridge.

As shown in FIG. 19, according to the modification of the second embodiment, the ink cartridge 30 comprises three protrusions 264, 265, 266, which protrude toward the outside in the horizontal direction (the width direction 51) perpendicular to the insertion/removal direction 50 from the surface 61 of the guide objective section 44. The three protrusions 264, 265, 266 have the same shape except that they are disposed in different positions. The three protrusions 264, 265, 266 are disposed at predetermined intervals in the insertion/removal direction 50. The respective protrusions 264, 265, 266 are configured to abut against a stopper 231 described later when the ink cartridge 30 is removed from the cartridge installing section 110.

Although not shown in the respective drawings, three protrusions, which are equivalent to the protrusions 264, 265, 266 described above, are also provided on the surface 62 of the guide objective section 44. The three protrusions form the pairs with the respective protrusions 264, 265, 266 on both sides of the guide objective section 44 in the horizontal direction (the width direction 51) perpendicular to the insertion/removal direction 50. The three protrusions are configured to abut against a stopper 232 described later when the ink cartridge 30 is removed from the cartridge installing section 110.

As described above, the respective protrusions 264, 265, 266 have the same shape except that they are disposed in different positions. Therefore, the shape of the protrusion 264 will be explained in detail, representing the protrusions 264, 265, 266. The protrusion 264 comprises a first guide surface 267 which is positioned on the front wall 40 side of the protrusion 264 in the insertion/removal direction 50 and which is faces obliquely downward, and a second guide surface 268 which is positioned on the back wall 42 side of the protrusion 264 and which faces obliquely downward. The first guide surface 267 and the second guide surface 268 are formed continuously in the insertion/removal direction 50. The protrusion 264 has an inverted triangular shape as viewed in a side view. Therefore, the first guide surface 267 abuts against the stopper 231 described later to guide the ink cartridge 30 upwardly in the vertical direction (the direction of the gravity) when the ink cartridge 30 is inserted into the cartridge installing section 110. The second guide surface 268 abuts against the stopper 231 described later to guide the ink cartridge 30 upwardly in the vertical direction (the direction of the gravity) when the ink cartridge 30 is removed from the cartridge installing section 110.

Each of the first guide surface 267 and the second guide surface 268 is a planar surface which is inclined with respect to the vertical direction (the direction of the gravity). However, the first guide surface 267 and the second guide surface 268 have different angles of inclination with respect to the direction of the gravity. The first angle R3 which is formed as an acute angle between the first guide surface 267 and the vertical direction (the direction of the gravity) is greater than the second angle R4 which is formed as an acute angle between the second guide surface 268 and the vertical direction (the direction of the gravity). In other words, the first guide surface 267 is a gentle inclined surface, and the second guide surface 268 is a steep inclined surface.

The protrusions 264, 265, 266 and the three protrusions which form the pairs with the protrusions 264, 265, 266, respectively, have distal ends in the horizontal direction (the width direction 51) perpendicular to the insertion/removal direction 50, i.e., the protruding distal ends which are positioned more inside than the right side surface 47 or the left side surface 48 of the main body 31. The distance between the distal ends of each of the pairs of the protrusions 264, 265, 266 and the three protrusions which form the pairs with the protrusions 264, 265, 266, respectively, is less than the distance between the side surfaces 117, 118 of the groove 115 in the horizontal direction (the width direction 51) perpendicular to the insertion/removal direction 50. Therefore, the protrusions 264, 265, 266 and the three protrusions which form the pairs with the protrusions 264, 265, 266 respectively can enter the groove 115, and they are smoothly movable in the insertion/removal direction 50 in the groove 115.

Figure 20:
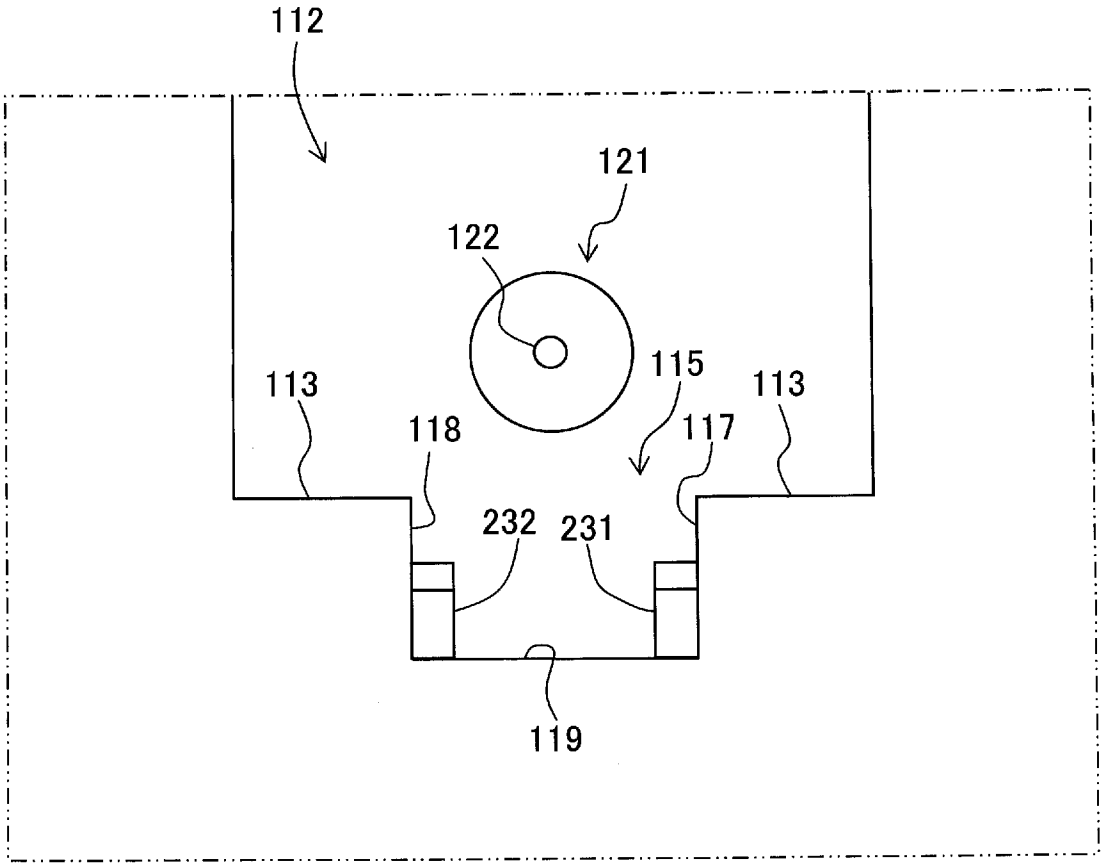
FIG. 20 is an enlarged front view of a cartridge installing section of the modification of the second embodiment in the vicinity of stoppers.

As shown in FIG. 20, the pair of stoppers 231, 232 are provided respectively on the pair of mutually opposing side surfaces 117, 118 of the groove 115 of the cartridge installing section 110. The stoppers 231, 232 protrude respectively in the horizontal direction (the width direction 51) perpendicular to the insertion/removal direction 50 from the side surfaces 117, 118. The surfaces of the stoppers 231, 232, which are disposed on the upper side in the vertical direction (the direction of the gravity), form mountain shapes. The side surfaces 117, 118 are an example of a third surface.

The distance between the distal ends of the stoppers 231, 232 which protrude in the horizontal direction (the width direction 51) perpendicular to the insertion/removal direction is less than the distance between the distal ends of each of the pairs of the protrusions 264, 265, 266 and the three protrusions which form the pairs with the protrusions 264, 265, 266, respectively. Therefore, the protrusions 264, 265, 266 and the three protrusions which form the pairs with the protrusions 264, 265, 266, respectively, which enter the groove 115 to move in the insertion/removal direction 50, necessarily abut against the stoppers 231, 232.

Figure 21:
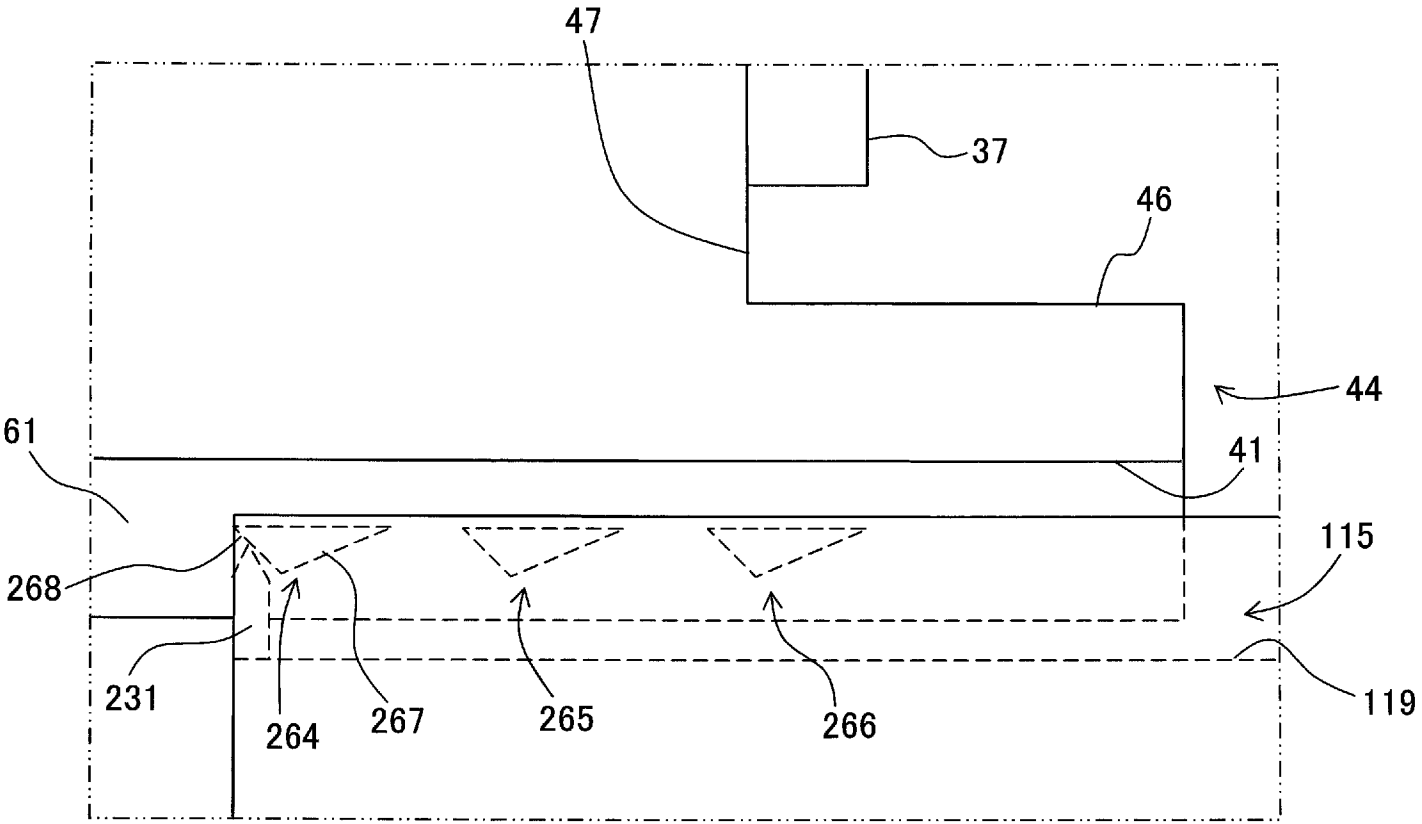
FIG. 21 is an enlarged view of the ink cartridge and the cartridge installing section of the modification of the second embodiment in the vicinity of the protrusions of the ink cartridge and the stopper of the cartridge installing section, in which the protrusion abuts against the stopper.

The protrusions 264, 265, 266 and the three protrusions which form the pairs with the protrusions 264, 265, 266, respectively, abut against the stoppers 231, 232 when the ink cartridge 30 is inserted into and removed from the cartridge installing section 110. For example, as shown in FIG. 21, the protrusion 264 abuts against the stopper 231 when the ink cartridge 30 is removed from the cartridge installing section 110. The velocity at which the ink cartridge 30 moves is attenuated or damped every time when the respective protrusions 264, 265, 266 climbs over the stopper 231.

The function and the effect, which are the same as or equivalent to those of the second embodiment, can be also provided by the stoppers 231, 232 and the protrusions 264, 265, 266 and the three protrusions which form the pairs with the protrusions 264, 265, 266, respectively.

In this modification of the second embodiment, the protruding distal ends of the protrusions 264, 265, 266 and the three protrusions which form the pairs with the protrusions 264, 265, 266, respectively, are positioned more inside than the right side surface 47 or the left side surface 48 of the main body 31 in the width direction 51. Therefore, damage and/or deformation of the protrusions 264, 265, 266 when the ink cartridge 30 falls onto the floor, or when the ink cartridge 30 is packed in a package formed of film and the inside of the package is depressurized, is reduced or eliminated.

In the second embodiment and the modification thereof, the surfaces of the respective protrusions and the stoppers are the inclined surfaces which are inclined with respect to the vertical direction (the direction of the gravity). However, the inclined surfaces may not be provided for both of the respective protrusions and the stoppers. For example, the inclined surface such as the first guide surface 257 or the second guide surface 258 may be provided for either the protrusions or the stoppers, and any various shapes may be adopted for the other, such that the ink cartridge 30 is guided upwardly in the vertical direction (the direction of the gravity) by the first guide surface 257 and the second guide surface 258. The first guide surface 257 and the second guide surface 285 may not be planar surfaces. The first guide surface 257 and the second guide surface may be curved surfaces or spherical surfaces.

In the second embodiment and the modification thereof, the three protrusions 254, 255, 256 or the protrusions 264, 265, 266 are provided while being offset and aligned in the insertion/removal direction 50 for one ink cartridge 30. However, the number of the protrusions provided and aligned in the insertion/removal direction 50 is not limited to three in the present invention. The number may be a plural of two or more. The protrusions 254, 255, 256 or the protrusions 264, 265, 266 are positioned adjacent to the front wall 40 of the main body 31. However, the positions of the respective protrusions may be appropriately changed, for example, such that the protrusions are positioned adjacent to the back wall 42.

In the second embodiment and the modification thereof, the three protrusions 254, 255, 256 and the three protrusions which form the pairs with the protrusions 254, 255, 256, respectively, or the protrusions 264, 265, 266 and the three protrusions which form the pairs with the protrusions 264, 265, 266, respectively, are provided on the both side surfaces 61, 62 of the guide objective section 44, respectively. However, the protrusions 254, 255, 256 or the protrusions 264, 265, 266 may be provided on only one side surface 61 of the guide objective section 44. In this case, only the stopper 226 or 231 may be arranged on the cartridge installing section 110.

In the second embodiment and the modification thereof, the three pairs of the protrusions are provided and aligned in the insertion/removal direction 50 for one ink cartridge 30. However, the number of the protrusion(s) may be one, or one pair provided on both side of the guide objective section 63. In this case, a plurality of stoppers, which are the same as or equivalent to the stoppers 226 or 231, may be provided and aligned, or a plurality of stopper pairs, which are the same as or equivalent to the stopper pairs 226, 227 or 231, 231, may be provided and aligned, in the insertion/removal direction 50. Even in this case, the velocity at which the ink cartridge 30 moves is attenuated or damped when the protrusion climbs over the stopper a plurality of times.

In the first and second embodiments and the modifications thereof described above, the slide member 135 and the coil spring 139, which are an example of an urging member, are provided in the cartridge installing section 110. However, the urging member may be provided in the ink cartridge 30 as long as the ink cartridge 30 is urged toward the opening 112 by the urging member. For example, a coil spring may be provided on the front wall 40 of the ink cartridge 30 facing the end portion of the cartridge installing section 110 when the ink cartridge 30 is installed in the cartridge installing section 110.

What is claimed is:

1. A liquid supply apparatus comprising:

a liquid container configured to store the liquid therein;

an installing section which is formed with an opening, wherein the liquid container is configured to be inserted into the installing section via the opening in an insertion direction and thereby installed in the installing section; and an urging member configured to urge the liquid container installed in the installing section toward the opening, wherein the installing section comprises:

a guide section which extends from the opening in the insertion direction;

at least one stopper which protrudes from the guide section or from a portion adjacent to the guide section in a direction perpendicular to a removal direction which is opposite to the insertion direction; and a holding member configured to releasably hold the liquid container in the installing section against an urging force exerted by the urging member, wherein the liquid container comprises:

a storage chamber configured to store the liquid therein;

a guide objective section configured to move in the insertion direction and the removal direction, guided by the guide section, when the liquid container is inserted into and removed from the installing section; and at least one protrusion provided on or adjacent to the guide objective section and configured to abut against the at least one stopper, such that the liquid container moves in the direction perpendicular to the removal direction and the at least one stopper does not move in the direction perpendicular to the removal direction, when the liquid container is moved in the removal direction;

wherein the at least one stopper comprises a plurality of stoppers which are offset in the removal direction and/or the at least one protrusion comprises a plurality of protrusions which are offset in the removal direction.

2. The liquid supply apparatus according to claim 1, wherein: the guide section comprises a groove extending from the opening in the insertion direction and defined by a first side surface, a second side surface opposite the first side surface, and a bottom surface, wherein the groove extends to the bottom surface in a vertical direction;

the at least one stopper comprises a first stopper which protrudes from the first side surface toward the second side surface and a second stopper which protrudes from the second side surface toward the first side surface;

the guide objective section is configured to be inserted into the groove of the guide section, and comprises a first surface and a second surface opposite the first surface;

the at least one protrusion comprises a first protrusion which protrudes from the first surface and a second protrusion which protrudes from the second surface, wherein the first surface faces the first side surface and the second surface faces the second side surface when the liquid container is installed in the installing section;

the first stopper is positioned between the opening and the first protrusion and the second stopper is positioned between the opening and the second protrusion when the liquid container is installed in the installing section;

the first protrusion and the second protrusion are offset from each other in the removal direction; and a distance between a distal end of the first stopper and a distal end of the second stopper in a horizontal direction which is perpendicular to the insertion direction and the removal direction is:

less than a distance between a distal end of the first protrusion and a distal end of the second protrusion in the horizontal direction which is perpendicular to the insertion direction and the removal direction; and greater than a width of the guide objective section including either one of the first protrusion and the second protrusion in the horizontal direction which is perpendicular to the insertion direction and the removal direction.

3. The liquid supply apparatus according to claim 1, wherein: the guide section comprises a groove extending from the opening in the insertion direction and defined by a first side surface, a second side surface opposite the first side surface, and a bottom surface, wherein the groove extends to the bottom surface in a vertical direction;

the at least one stopper comprises a first stopper which protrudes from the first side surface toward the second side surface and a second stopper which protrudes from the second side surface toward the first side surface;

the guide objective section is configured to be inserted into the groove of the guide section, and comprises a first surface and a second surface opposite the first surface;

the at least one protrusion comprises a first protrusion which protrudes from the first surface and a second protrusion which protrudes from the second surface, wherein the first surface faces the first side surface and the second surface faces the second side surface when the liquid container is installed in the installing section;

the first stopper is positioned between the opening and the first protrusion and the second stopper is positioned between the opening and the second protrusion when the liquid container is installed in the installing section;

the first stopper and the second stopper are offset from each other in the removal direction; and a distance between a distal end of the first protrusion and a distal end of the second protrusion in a horizontal direction which is perpendicular to the insertion direction and the removal direction is:

greater than a distance between a distal end of the first stopper and a distal end of the second stopper in the horizontal direction which is perpendicular to the insertion direction and the removal direction;

less than a distance from the distal end of the first stopper to the second side surface in the horizontal direction which is perpendicular to the insertion direction and the removal direction; and less than a distance from the distal end of the second stopper to the first side surface in the horizontal direction which is perpendicular to the insertion direction and the removal direction.

4. The liquid supply apparatus according to claim 2, wherein: the first protrusion is positioned closer to the opening than the second protrusion is, and the first stopper is positioned closer to the opening than the second stopper is, when the liquid container is installed in the installing section; and a distance between the distal end of the first protrusion and the distal end of the second protrusion in the removal direction is different from a distance between the distal end of the first stopper and the distal end of the second stopper in the removal direction.

5. The liquid supply apparatus according to claim 3, wherein: the first protrusion is positioned closer to the opening than the second protrusion is, and the first stopper is positioned closer to the opening than the second stopper is, when the liquid container is installed in the installing section; and a distance between the distal end of the first protrusion and the distal end of the second protrusion in the removal direction is different from a distance between the distal end of the first stopper and the distal end of the second stopper in the removal direction.

6. The liquid supply apparatus according to claim 2, wherein:

at least one of the first stopper and the first protrusion comprises a first inclined surface which is inclined with respect to the horizontal direction which is perpendicular to the insertion direction and the removal direction and which is configured to abut against the first stopper or the first protrusion when the liquid container is inserted into the installing section, and at least one of the first stopper and the first protrusion comprises a second inclined surface which is inclined with respect to the horizontal direction which is perpendicular to the insertion direction and the removal direction and which is configured to abut against the first stopper or the first protrusion when the liquid container is removed from the installing section; and at least one of the second stopper and the second protrusion comprises a third inclined surface which is inclined with respect to the horizontal direction which is perpendicular to the insertion direction and the removal direction and which is configured to abut against the second stopper or the second protrusion when the liquid container is inserted into the installing section, and at least one of the second stopper and the second protrusion comprises a fourth inclined surface which is inclined with respect to the horizontal direction which is perpendicular to the insertion direction and the removal direction and which is configured to abut against the second stopper or the second protrusion when the liquid container is removed from the installing section.

7. The liquid supply apparatus according to claim 6, wherein:

a first angle which is formed as an acute angle between the first inclined surface and the horizontal direction which is perpendicular to the insertion direction and the removal direction is greater than a second angle which is formed as an acute angle between the second inclined surface and the horizontal direction which is perpendicular to the insertion direction and the removal direction; and a third angle which is formed as an acute angle between the third inclined surface and the horizontal direction which is perpendicular to the insertion direction and the removal direction is greater than a fourth angle which is formed as an acute angle between the fourth inclined surface and the horizontal direction which is perpendicular to the insertion direction and the removal direction.

8. The liquid supply apparatus according to claim 3, wherein:

at least one of the first stopper and the first protrusion comprises a first inclined surface which is inclined with respect to the horizontal direction which is perpendicular to the insertion direction and the removal direction and which is configured to abut against the first stopper or the first protrusion when the liquid container is inserted into the installing section, and at least one of the first stopper and the first protrusion comprises a second inclined surface which is inclined with respect to the horizontal direction which is perpendicular to the insertion direction and the removal direction and which is configured to abut against the first stopper or the first protrusion when the liquid container is removed from the installing section; and at least one of the second stopper and the second protrusion comprises a third inclined surface which is inclined with respect to the horizontal direction which is perpendicular to the insertion direction and the removal direction and which is configured to abut against the second stopper or the second protrusion when the liquid container is inserted into the installing section, and at least one of the second stopper and the second protrusion comprises a fourth inclined surface which is inclined with respect to the horizontal direction which is perpendicular to the insertion direction and the removal direction and which is configured to abut against the second stopper or the second protrusion when the liquid container is removed from the installing section.

9. The liquid supply apparatus according to claim 8, wherein:

a first angle which is formed as an acute angle between the first inclined surface and the horizontal direction which is perpendicular to the insertion direction and the removal direction is greater than a second angle which is formed as an acute angle between the second inclined surface and the horizontal direction which is perpendicular to the insertion direction and the removal direction; and a third angle which is formed as an acute angle between the third inclined surface and the horizontal direction which is perpendicular to the insertion direction and the removal direction is greater than a fourth angle which is formed as an acute angle between the fourth inclined surface and the horizontal direction which is perpendicular to the insertion direction and the removal direction.

10. The liquid supply apparatus according to claim 1, wherein: the guide section comprises a groove extending from the opening in the insertion direction and positioned under the liquid container when the liquid container is installed in the installing section; and the installing section comprises a third surface positioned at or adjacent to the groove, and the at least one stopper protrudes from the third surface; and the liquid container comprises a fourth surface positioned at or adjacent to the guide objective section, and the at least one protrusion protrudes from the fourth surface, wherein the fourth surface faces the third surface when the liquid container is installed in the installing section.

11. The liquid supply apparatus according to claim 10, wherein: the at least one stopper or the at least one protrusion comprises a first guide surface which is configured to abut against the at least one stopper or the at least one protrusion to guide the liquid container upwardly in a vertical direction when the liquid container is inserted into the installing section; and the at least one stopper or the at least one protrusion comprises a second guide surface which is configured to abut against the at least one stopper or the at least one protrusion to guide the liquid container upwardly in the vertical direction when the liquid container is removed from the installing section.

12. The liquid supply apparatus according to claim 11, wherein: the first guide surface and the second guide surface are inclined with respect to the vertical direction, respectively; and a first angle which is formed as an acute angle between the first guide surface and the vertical direction is greater than a second angle which is formed as an acute angle between the second guide surface and the vertical direction.

13. The liquid supply apparatus according to claim 10, wherein: the at least one stopper comprises a pair of stoppers which are provided on both sides of the groove in a horizontal direction which is perpendicular to the insertion direction and the removal direction; and the at least one protrusion comprises a pair of protrusions which are provided on both sides of the guide objective section in the horizontal direction which is perpendicular to the insertion direction and the removal direction.

14. The liquid supply apparatus according to claim 10, wherein: the third surface faces upward in a vertical direction;

the at least one stopper protrudes upward in the vertical direction from the third surface;

the fourth surface faces downward in the vertical direction; and the protrusion protrudes downward in the vertical direction from the fourth surface.

15. The liquid supply apparatus according to claim 10, wherein: each of the third surface and the fourth surface extends in a vertical direction and the insertion direction and the removal direction; and each of the at least one stopper and the at least one protrusion protrudes in a horizontal direction which is perpendicular to the insertion direction and the removal direction.

16. An image recording apparatus comprising:

the liquid supply apparatus as defined in claim 1; and a recording section which records an image on a recording medium by selectively discharging the liquid supplied from the liquid supply apparatus.

* * * * *